US008079486B2

(12) United States Patent
Yamauchi

(10) Patent No.: US 8,079,486 B2
(45) Date of Patent: Dec. 20, 2011

(54) FOLDING CONTAINER

(75) Inventor: Hisatoshi Yamauchi, Mizuho (JP)

(73) Assignee: Sanko Co., Ltd., Mizuho-shi (JP)

( * ) Notice: Subject to any disclaimer, the term of this patent is extended or adjusted under 35 U.S.C. 154(b) by 218 days.

(21) Appl. No.: 12/544,358

(22) Filed: Aug. 20, 2009

(65) Prior Publication Data

US 2010/0230406 A1 Sep. 16, 2010

(30) Foreign Application Priority Data

Mar. 13, 2009 (JP) ..... 2009-060709

(51) Int. Cl.
*B65D 6/18* (2006.01)

(52) U.S. Cl. ..... 220/7; 220/6

(58) Field of Classification Search ..... 220/6, 7
See application file for complete search history.

(56) References Cited

U.S. PATENT DOCUMENTS

| | | | | |
|---|---|---|---|---|
| 5,207,899 | A | 5/1993 | Boyle | |
| 5,632,392 | A * | 5/1997 | Oh | 220/7 |
| 6,290,081 | B1 * | 9/2001 | Merey | 220/7 |
| 7,011,225 | B2 * | 3/2006 | Oster et al. | 220/7 |
| 7,195,128 | B2 | 3/2007 | Murakami et al. | |
| 7,861,878 | B2 * | 1/2011 | Escarpa Gil | 220/7 |
| 2003/0000950 | A1 | 1/2003 | Murakami et al. | |
| 2010/0230406 | A1 | 9/2010 | Yamauchi | |
| 2010/0320202 | A1 * | 12/2010 | Yamauchi | 220/6 |
| 2011/0049145 | A1 * | 3/2011 | Yamauchi | 220/7 |

FOREIGN PATENT DOCUMENTS

JP 2003-40263 A 2/2003

OTHER PUBLICATIONS

Related US Office Action dated Jul. 27, 2011 issued in U.S Appl. No. 12/544,310.

* cited by examiner

*Primary Examiner* — Stephen Castellano
(74) *Attorney, Agent, or Firm* — Westerman, Hattori, Daniels & Adrian, LLP

(57) ABSTRACT

A lock member L1 including an operation portion L1*a* and a lock bar L1*b* is disposed on each of first opposite side walls 2 to be brought down firstly toward a bottom portion 1, and a pivotal shaft 13 formed in the operation portion is pivotally supported in a bearing hole 2*g*2 formed in each of the first opposite side walls to be brought down firstly toward the bottom portion. To allow cancellation of a lock state between the lock member and each of second opposite side walls to be brought down secondly toward the bottom portion, the operation portion is pivotally moved downward. During an unlocking operation, even when an operator pivotally moves the operation portion included in the lock member, the operation portion is prevented from being tilted. Thus, the lock bar of the lock member can be used to reliably perform the unlocking operation.

8 Claims, 30 Drawing Sheets

L1

L1a

L1a

L1b

L1a

FOLDING CONTAINER

FIELD OF THE INVENTION

The present invention relates to a folding container in which side walls disposed so as to surround a bottom portion can be folded so as to lie on top of the bottom portion.

BACKGROUND OF THE INVENTION

Folding containers are conventionally known which are composed of long side walls connected, via hinge members, to respective opposite long side portions of a bottom portion formed so as to have a rectangular planar shape and short side walls also connected, via hinge members, to respective opposite short side portions of the bottom portion. The long side walls and the short side walls are set up perpendicularly to the bottom portion to assemble the side walls and the bottom portion into a box form. Furthermore, when the folding container is folded, the long side walls and the short side walls are folded so as to lie on top of the bottom portion. With the folding container assembled into the box form, the long side walls and the short side walls are locked by lock members so as to prevent the long side walls or the short side walls from falling down toward the bottom portion.

By way of example, the Unexamined Japanese Patent Application Publication (Tokkai) No. 2003-40263 discloses a folding container in which a locking operation and an unlocking operation are performed as follows. An operation portion of a lock member disposed on each short side wall is moved in a vertical direction. Furthermore, the vertical movement of the operation portion is converted into horizontal movement via an appropriate mechanism such as a link mechanism to move a bar-like member to move in a horizontal direction. The tip of the bar-like member is thus inserted into or removed from an engaging portion formed in a corresponding long side wall. Consequently, the long side walls and the short side walls are locked or unlocked so as to prevent the short side walls from falling down toward a bottom portion.

According to the above-described conventional folding container, to fold the folding container assembled into the box form, an operator pushes the operation portion downward. However, depending on a position where the operator pushes the operation portion downward, the operation portion may be tilted during the downward movement instead of being moved downward in a horizontal state. Where the operation portion is tilted during the downward movement, the paired bar-like members positioned on the right and left of the operation portion vary in projection amount or retraction amount. This disadvantageously results in an unreliable unlocking operation.

Furthermore, the vertical movement of the operation portion is converted into the horizontal movement of the bar-like members via a complicated mechanism. Thus, a heavy transmission loss is involved in the conversion of the vertical movement of the operation portion into the horizontal movement of the bar-like members. Thus, a strong force is required to move the operation portion in the vertical direction, hindering a quick unlocking operation.

SUMMARY OF THE INVENTION

An object of the present invention is to solve the problems with the above-described conventional folding container.

To accomplish the above-described object, the present invention provides a folding container having first opposite side walls which, when the folding container is in an assembled box form, are brought down firstly toward a bottom portion, and second opposite side walls which are brought down secondly toward the bottom portion after the first opposite side walls haven been brought down, wherein a lock member comprising an operation portion and a lock bar is disposed on each of the first opposite side walls to be brought down firstly toward the bottom portion, and a pivotal shaft formed in the operation portion is pivotally supported in a bearing hole formed in each of the first opposite side walls to be brought down firstly toward the bottom portion, and wherein to allow cancellation of a lock state between the lock member and each of the second opposite side walls to be brought down secondly toward the bottom portion, the operation portion is, when the lock member is in the locked state, pivotally moved upward or downward.

In the folding container having the first opposite side walls which, when the folding container is in the assembled box form, are brought down firstly toward the bottom portion and the second opposite side walls which are brought down secondly toward the bottom portion after the first opposite side walls haven been brought down, the lock member comprising the operation portion and the lock bar is disposed on each of the first opposite side walls to be brought down firstly toward the bottom portion, and the pivotal shaft formed in the operation portion is pivotally supported in the bearing hole formed in each of the first opposite side walls to be brought down firstly toward the bottom portion. Furthermore, to allow the lock member to be unlocked from each of the second opposite side walls to be brought down secondly toward the bottom portion, the operation portion is, when the lock member is in the locked state, pivotally moved upward or downward. Thus, during the unlocking operation, the operation portion is prevented from being tilted even when the operator pivotally moves the operation portion belonging to the lock member. Consequently, the unlocking operation can be reliably achieved using the lock bar belonging to the lock member.

DETAILED DESCRIPTION OF THE PREFERRED EMBODIMENT

An embodiment of the present invention will be described below. However, the present invention is not limited to the embodiment, and any other embodiment is possible without departing from the spirit of the present invention.

Figure 1:
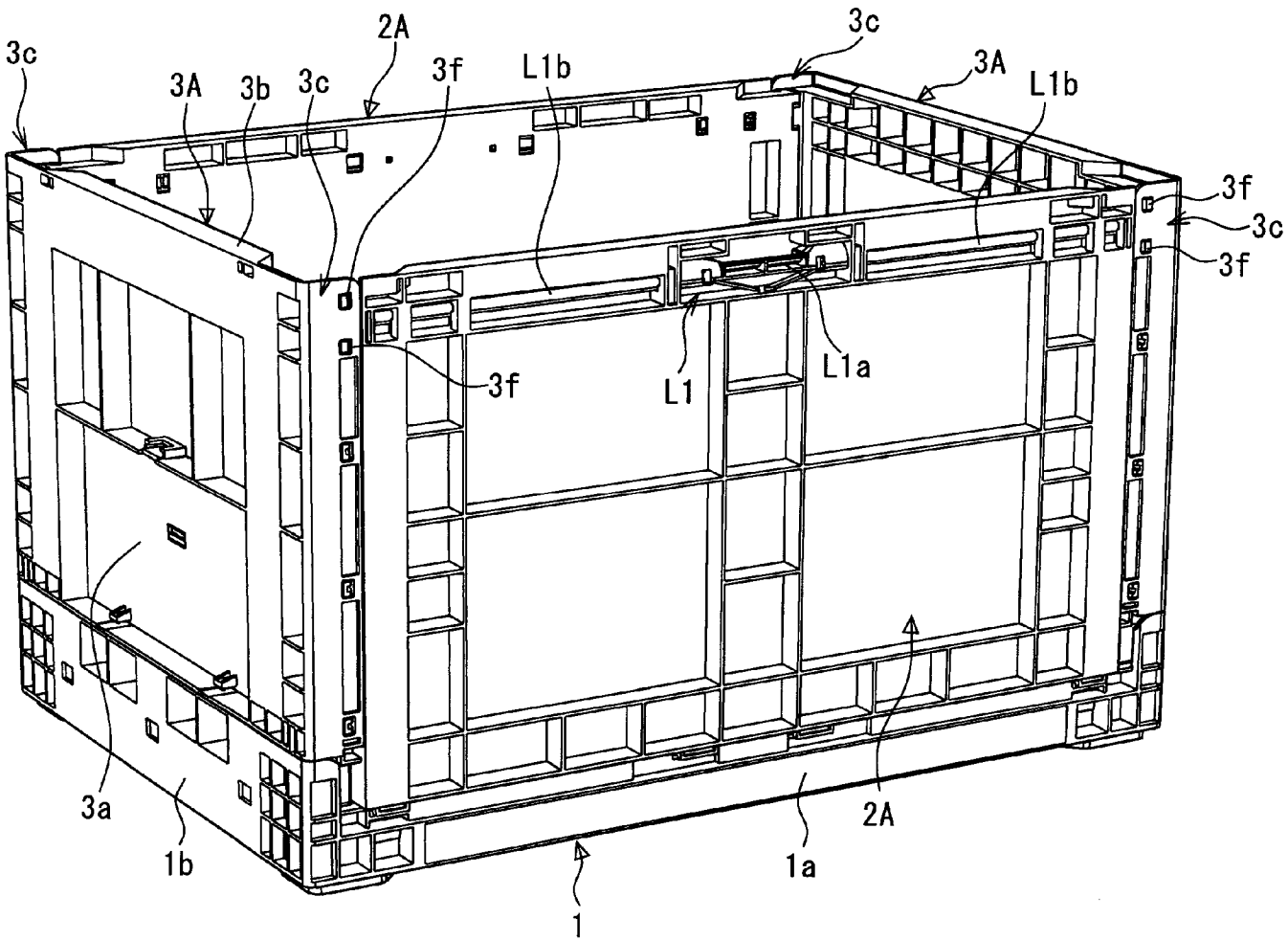
FIG. 1 is a perspective view of a folding container according to the present invention assembled in a box form.

As shown in FIG. 1, a folding container according to the present invention is composed of a bottom portion 1, long side walls 2A hinged to respective long-side bank portions la of the bottom portion 1, and short side walls 3A hinged to respective short-side bank portions 1*b* of the bottom portion 1. In the present embodiment, each of the long-side bank portions 1*a* is formed to be lower than each of the short-side bank portions 1*b*.

When the folding container is in an assembled box form as shown in FIG. 1, firstly, the long side walls 2A are brought down so as to lie on top of the bottom portion 1. Then, the short side walls 3A are brought down so as to lie on top of the long side walls 2A laid on top of the bottom portion 1. Thus, as is well known, the folding container can be folded into a low, compact form. Then, when the folding container is in a folded form, the short side walls 3A are set up vertically, and the long side walls 2A are set up vertically. Then, as shown in FIG. 1, the folding container can be assembled into the box form.

Figure 2:
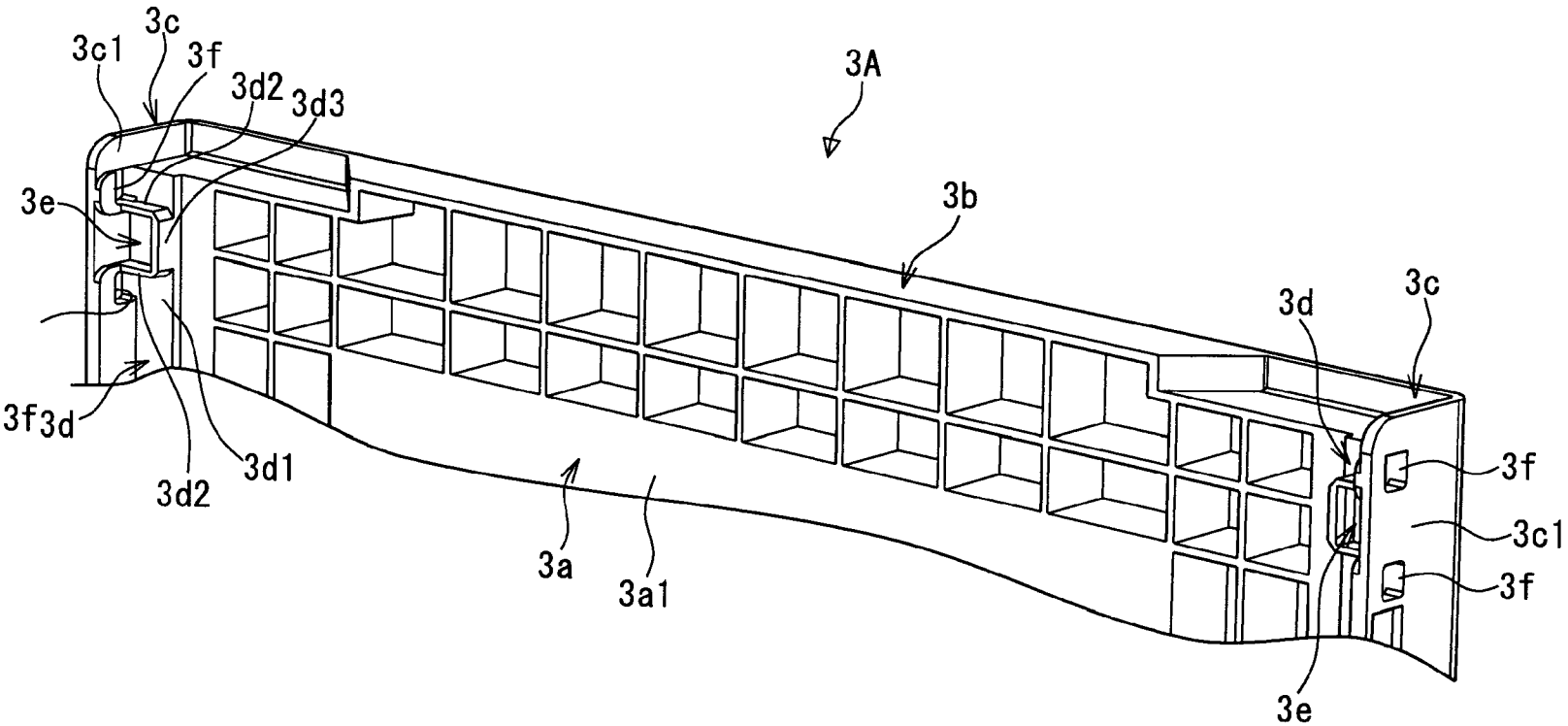
FIG. 2 is partial perspective view of a short side wall included in a folding container according to the present invention.

Now, the short side wall 3A will be described with reference to FIGS. 1 and 2.

The short side wall 3A has a plate-like portion 3*a*. An upper-end horizontal rib 3*b* is formed at the upper end of the short side wall 3A. Furthermore, a vertically long short side wall-side engaging member 3*c* is formed at each of opposite vertical ends of the short-side wall; the short side wall-side engaging member 3*c* is perpendicular to the plate-like portion 3*a* and to an inner surface (the surface which, when the folding container is assembled into the box form, is positioned inside the folding container assembled into the box form) 3*a*1 of the plate-like portion 3*a*. A vertically long prismatic block (hereinafter simply referred to as a corner block) 3*d* is formed in a corner portion formed by the inner surface 3*a*1 of the plate-like portion 3*a* and a vertically long band-like plate (hereinafter referred to as an end-side vertical plate) 3*c*1 included in the short wall-side engaging member 3*c* and which is perpendicular to the inner surface 3*a*1 of the plate-like portion 3*a*. Moreover, a pair of opposite, horizontal projecting pieces 3*d*2 and a vertical projecting piece 3*d*3 are formed at the upper end of a surface 3*d*1 of a corner portion vertically-long block 3*d* which lies parallel to the plate-like portion 3*a*; the vertical projecting piece 3*d*3 couples together the ends of the horizontal projecting piece 3*d*2 which lie opposite the end-side vertical plate 3*c*1. An engaging recess portion 3*e* is formed at the upper end of the corner block 3*d* which is surrounded by the horizontal protruding pieces 3*d*2, the vertical protruding piece 3*d*3, and the surface 3*d*1 of the corner block 3*d*. Additionally, on the end-side vertical plate 3*c*1, fitting holes 3*f* are formed in the vertical direction near the pair of horizontal protruding pieces 3*d*2.

Figure 3:
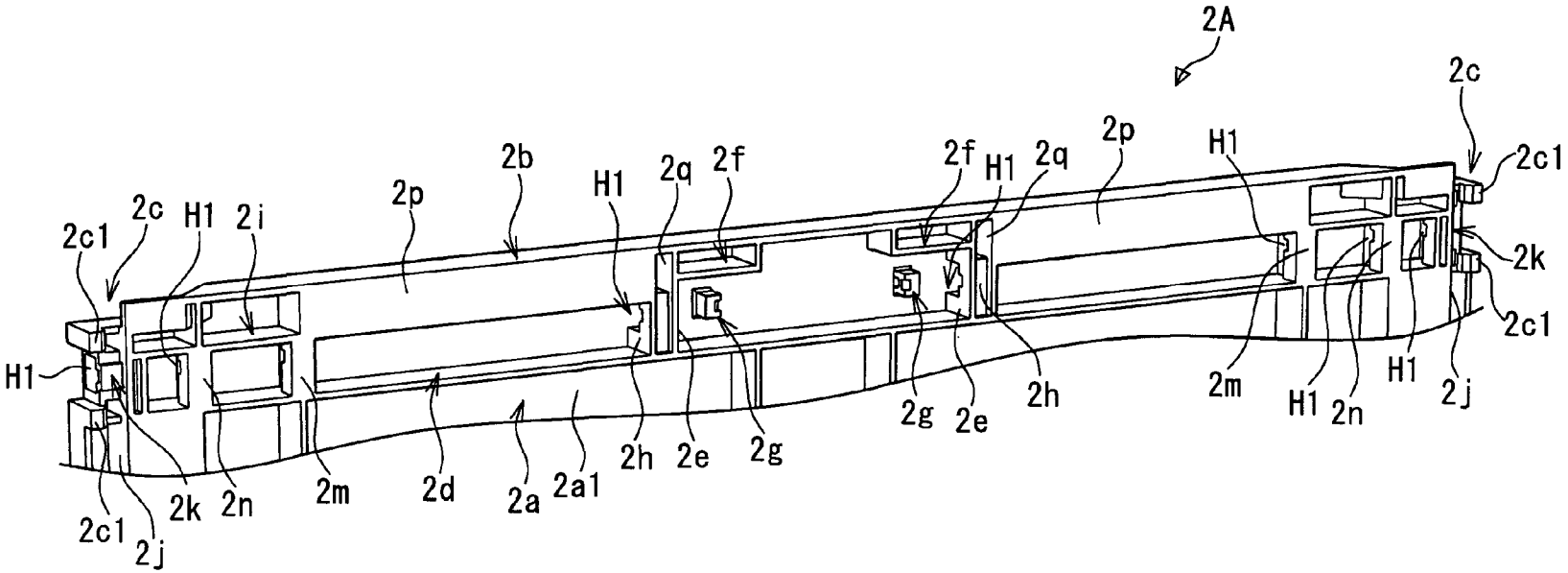
FIG. 3 is partial perspective view of a long side wall included in the folding container according to the present invention.
Figure 4:
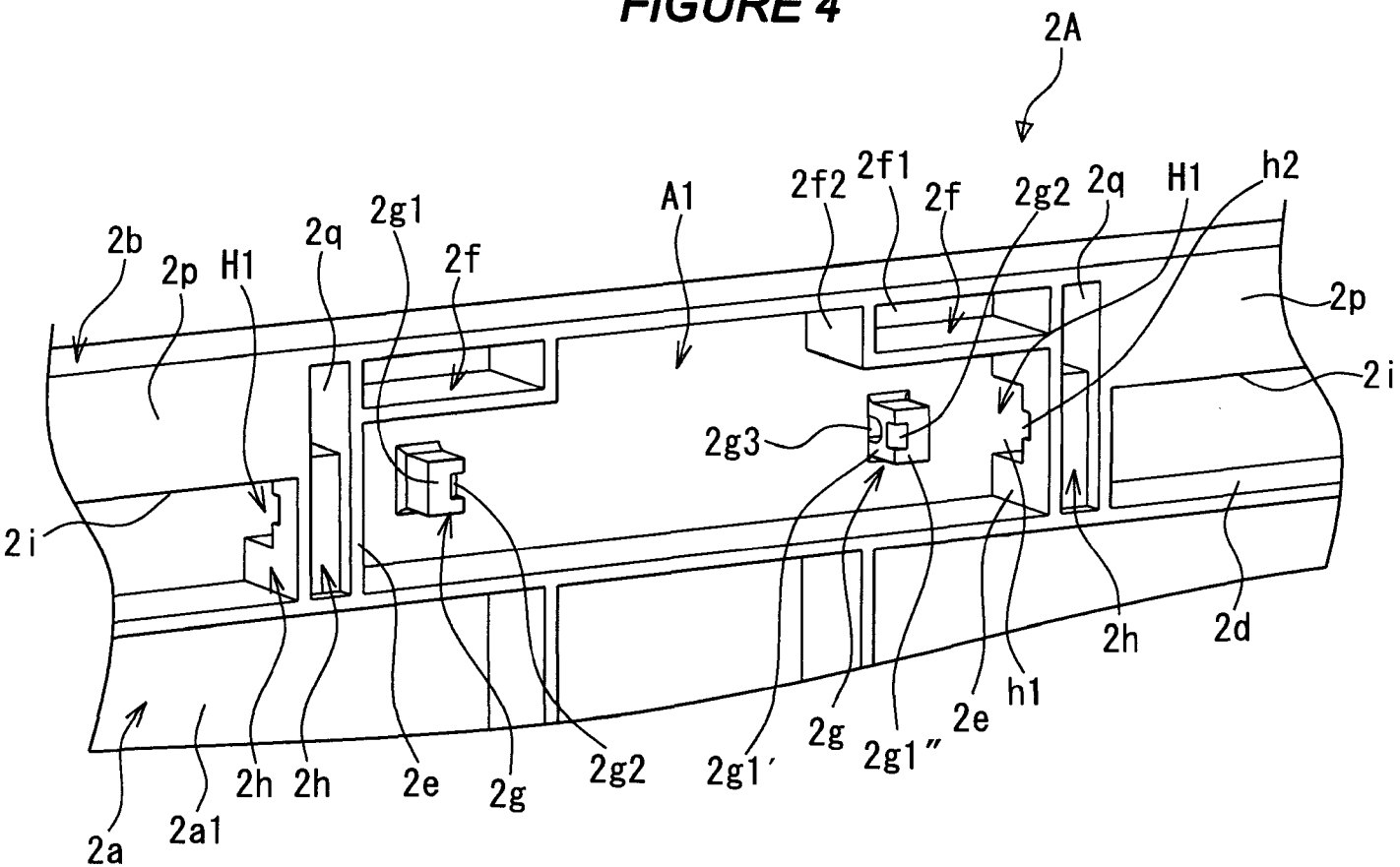
FIG. 4 is a partly enlarged perspective view of the long side wall included in the folding container according to the present invention.
Figure 5:
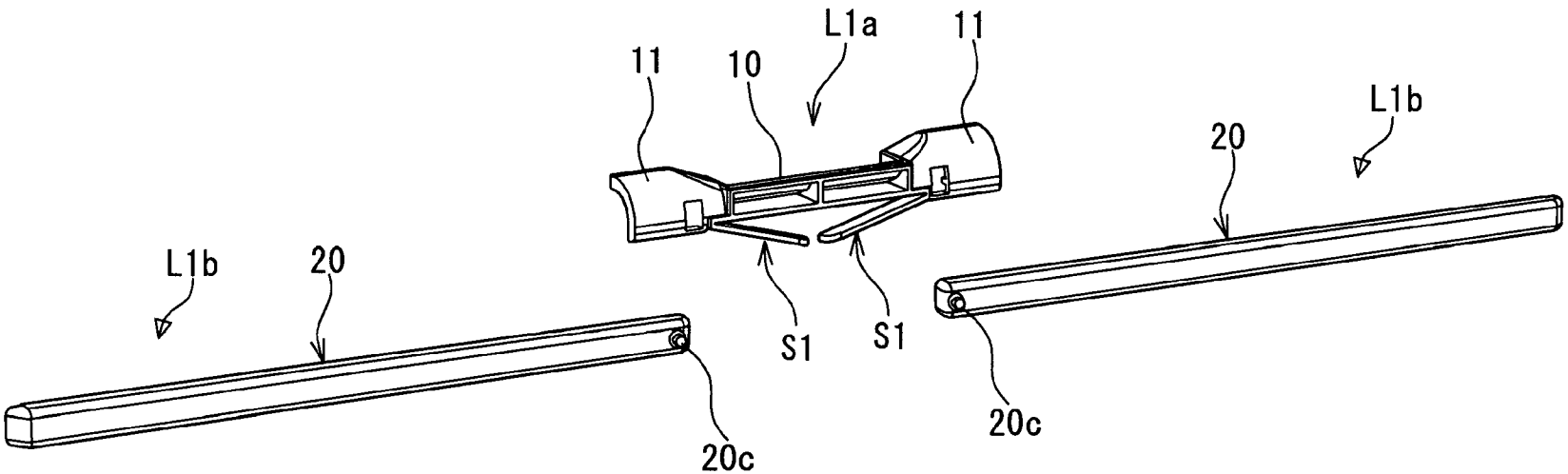
FIG. 5 is an exploded perspective view of a lock member included in the folding container according to the present invention.

Now, the long side wall 2A will be described with reference to FIGS. 1, 3, and 4.

The long side wall 2A has a plate-like portion 2*a*. An upper-end horizontal rib 2*b* is formed at the upper end of the long side wall 2A. A vertically long side wall-side engaging member 2*c* is formed at each of the opposite vertical ends of the long side wall 2A and extends in the direction of the plate-like portion 2*a* and outward. Fitting projecting portions 2*c*1 are formed at the upper end of the long side wall-side engaging portion 2*c* at a predetermined interval therebetween in the vertical direction and perpendicularly to the plate-like portion 2*a*; the fitting projecting portion 2*c*1 extends over the outer surface 2*a*1 of the plate-like portion 2*a* (the surface which, when the folding container is assembled into the box form, is positioned outside the folding container assembled into the box form). Moreover, an upper horizontal rib 2*d* is formed in the upper portion of the plate-like portion 2*a* at a predetermined distance from the upper-end horizontal rib 2*b* so as to extend to the long side wall-side engaging member 2*c*.

Paired opposite central coupling vertical ribs 2*e* are formed at a predetermined distance from each other so as to couple a central area of the upper-end horizontal rib 2*b* and a central area of the upper horizontal rib 2*d*. The upper-end horizontal rib 2*b*, the upper horizontal rib 2*d*, the pair of opposite central coupling vertical ribs 2*e*, and the outer surface 2*a*1 of the plate-like portion 2*a* form a central space portion A1. 2*f* is a regulation portion disposed in a corner portion formed by the bottom surface of the upper-end horizontal rib 2*b* positioned in the central space portion A1 and a central space portion A1-side side surface of the coupling vertical rib 2*e*. The regulation portion 2*f* is formed by a horizontal regulating rib 2*f*1 and a vertical rib 2*f*2.

2*g* is a pair of opposite pivotal shaft supporting blocks projected, at a predetermined distance from each other, on the outer surface 2*a*1 of the plate-like portion 2*a* positioned between the regulation portion 2*f* and the upper horizontal rib 2*d*. Each of the pivotal shaft supporting blocks 2*g* has a prismatic block main body 2*g*1. A guiding inclined surface 2*g*2 is formed in a central portion of a corner portion formed by opposite vertical side surfaces 2*g*1' of the block main body 2*g*1 and an outer surface 2*g*1" parallel to outer surface 2*a*1 of the plate-like portion 2*a*. A bearing hole 2*g*3 is formed in a central portion of the vertical side surface 2*g*1' lying very close to the outer surface 2*a*1 of the plate-like portion 2*a*.

A central guide block 2*h* is formed on a side surface of the central coupling vertical rib 2*e* positioned outside the central space portion A1, and is coupled to the outer surface 2*a*1 of the plate-like portion 2*a* and the upper surface of the upper horizontal rib 2*d*. A guiding through-hole H1 is drilled in the central guide block 2*h* and the central coupling vertical rib 2*e*. The guiding through-hole H1 is composed of a vertically long main guide insertion portion h1 formed in contact with the outer surface 2*a*1 of the plate-like portion 2*a*, and a driven pin insertion portion h2 formed in a central portion of a vertical surface of the main guide insertion portion h1 which lies opposite the outer surface 2*a*1 of the plate-like portion 2*a*.

2*i* is an intermediate horizontal rib formed between the upper-end horizontal rib 2*b* and the upper horizontal rib 2*d*, and extending along a terminal vertical side of the plate-like portion 2*a* from the central guide block 2*h* to a vertically long, terminal vertical rib 2*j* formed perpendicularly to the plate-like portion 2*a*. Furthermore, a terminal guide block 2*k* is formed on an outer side surface of the terminal vertical rib 2*i* positioned between the paired fitting projecting portions 2*c*1 included in the long side wall-side engaging member 2*c*. A guiding through-hole H1 similar to that drilled in the central guide block 2*h* and the central coupling vertical rib 2*e* as described above is drilled in the terminal guide block 2*k* and the terminal vertical rib 2*j*.

2*m* and 2*n* are intermediate guide blocks formed between the central guide block 2*h* and the terminal guide block 2*k* to couple the intermediate horizontal rib 2*i* and the upper horizontal rib 2*d* together. A guiding through-hole H1 similar to that drilled in the central guide block 2*h* and the central coupling vertical rib 2*e* as described above is drilled in the intermediate guide blocks 2*m*, 2*n*. The number of intermediate guide blocks formed may be one or three or more.

2*p* is a plate-like coupling plate coupling the tip of the intermediate horizontal rib 2*i* and the tip of the upper-end horizontal rib 2*b* which are positioned between the intermediate horizontal rib 2*m* and the central guide block 2*h* to the tip of the central coupling vertical rib 2*e*. Furthermore, 2*q* is a space portion formed in the upper portion and front surface of the central guide block 2*h* in order to reduce the weight of the container and to save materials.

Now, a lock member L1 composed of an operation portion L1*a* and a pair of lock bars L1*b* will be described with reference to FIGS. 5 to 9.

Figure 6:
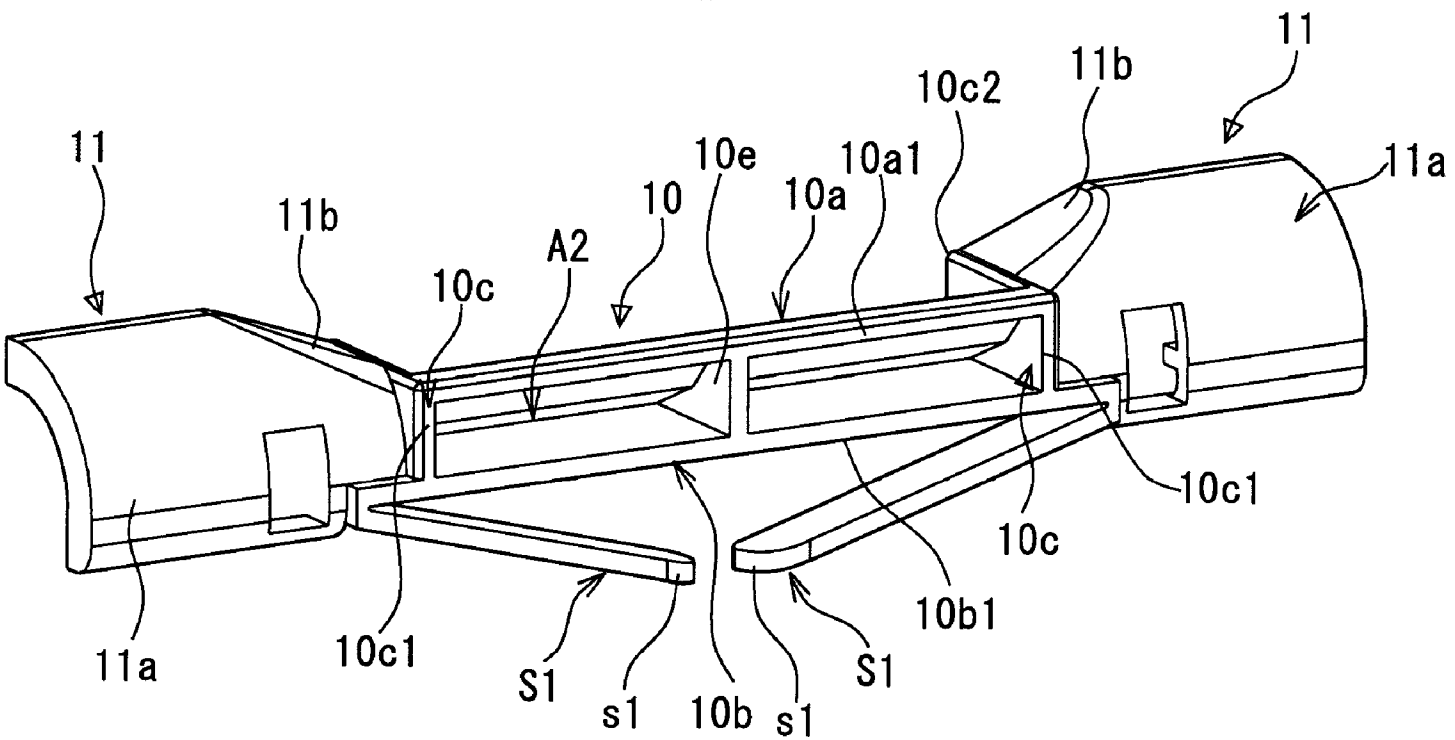
FIG. 6 is a perspective view of an operation portion of the lock member included in the folding container according to the present invention.

First, the operation portion L1*a* will be described mainly with reference to FIGS. 6 and 7.

The operation portion L1*a* is composed of a horizontally long operation main body 10 and cam portions 11 connected to opposite-end vertical side surfaces of the operation main body 10. The operation main body 10 has a bar-like upper-end horizontal beam 10*a*, a band-like lower-end horizontal beam 10*b*, and a vertical end walls 10*c* located at the opposite ends thereof. The upper-end horizontal beam 10*a* and the lower-end horizontal beam 10*b* are coupled together by a coupling inclined wall 10*d*. A rear surface (which, when the lock member L1 is attached to the long side wall 2, is positioned on the plate-like portion 2*a* side) 10*d*1 is formed as an inclined surface which, when the lock member L1 is attached to the long side wall 2, extends from the upper-end horizontal beam 10*a* toward the lower-end horizontal beam 10*b* and gradually toward the plate-like portion 2*a* of the long side wall 2.

The following are configured to be flush with one another: a vertical tip surface (which, when the lock member L1 is attached to the long side wall 2, is positioned farther from the plate-like portion 2*a*) 10*a*1 of the upper-end horizontal beam 10*a*, a vertical tip surface (which, when the lock member L1 is attached to the long side wall 2A, is positioned farther from the plate-like portion 2*a*) 10*b*1 of the lower-end horizontal beam 10*b*, and opposite vertical tip surfaces (which, when the lock member L1 is attached to the long side wall 2A, are positioned farther from the plate-like portion 2*a*) 10*c*1 of the vertical-end wall 10*c*. In this configuration, an operation space portion A2 is formed in the front surface (which, when the lock member L1 is attached to the long side wall 2A, is positioned farther from the plate-like portion 2*a*) of the operation main body 10 so that the operator's finger can be inserted into the operation space portion A2. An intermediate reinforcing wall 10*e* coupling the coupling inclined wall 10*d* and the lower-end horizontal beam 10*b* together may be formed midway between the opposite vertical end walls 10*c* as required to partition the operation space portion A2.

A cam portion 11 connected to the vertical end wall 10*c* of the operation main body 10 has a segment member 11*a* extending from the vertical tip surface 10*c*1 of the vertical end wall 10*c* to a vertical rear surface (which, when the lock member L1 is attached to the long side wall 2A, is positioned on the plate-like portion 2*a* side) 10*c*2 of the vertical end wall 10*c*, and shaped like a substantial quarter of a cylinder. The segment member 11*a* is bent upward from the vertical tip surface 10*c*1 toward the vertical rear surface 10*c*2 of the vertical end wall 10*c*. Furthermore, an inclined surface 11*b* inclined downward toward the vertical end wall 10*c* is formed on the vertical end wall 10*c* side of the segment member 11*a*. A partitioning wall 11*c* parallel to the vertical end wall 10*c* is formed in a substantial boundary area between the segment member 11*a* and the inclined surface 11*b*, and on an inner peripheral surface (which, when the lock member L1 is attached to the long side wall 2A, is positioned on the plate-like portion 2*a* side) 11*a*2 of the segment member 11*a*.

A cam groove 12A is formed in the inner peripheral surface 11*a*2 so as to extend from a lower end 11*a*3 toward an upper end 11*a*4 of the segment member 11*a* and gradually toward the partitioning wall 11*c*. Furthermore, a pivotal shaft 13 is projected from an outer wall surface (a side surface positioned opposite the operation main body 10) 11*c*1 of the partitioning wall 11*c*.

Additionally, a pair of downward-inclined flat-plate-like spring members S1 is provided on the bottom surface of the lower-end horizontal beam 10*b* so as to hang from the vicinities of the respective ends of the lower-end horizontal beam 10*b* toward the central portion of the lower-end horizontal beam 10*b*.

Figure 8:
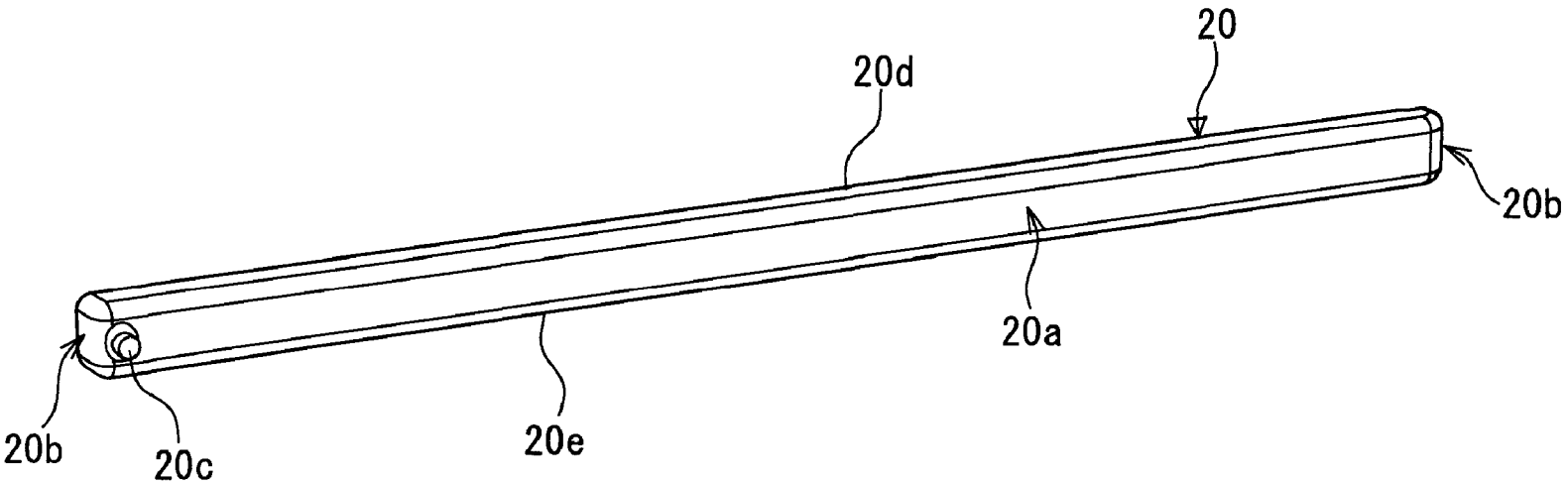
FIG. 8 is a perspective view of a lock bar of the lock member included in the folding container according to the present invention.
Figure 9:
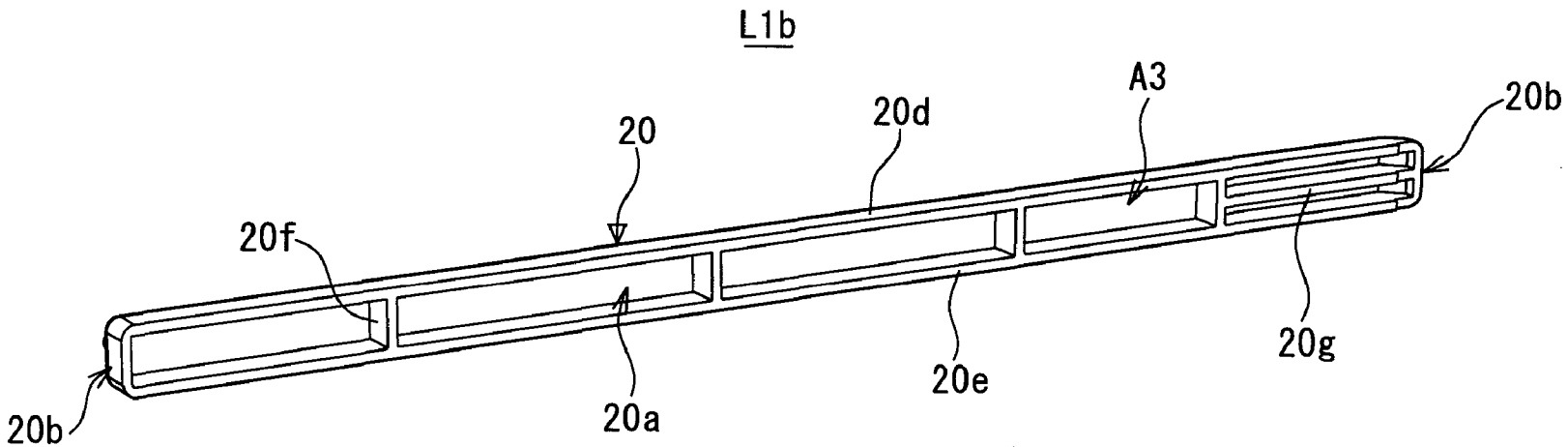
FIG. 9 is, like FIG. 8, a perspective view of the lock bar of the lock member included in the folding container according to the present invention.

Now, the lock bar L1*b* will be described mainly with reference to FIGS. 8 and 9.

The lock bar L1*b* has a horizontally long bar-like member 20. A driven pin 20*c* fitted into a cam groove 12A formed in an inner peripheral surface 11*a*2 of the segment member 11*a* of the above-described operation portion L1*a* is projected from a portion of a front plate (a horizontally long band-like plate which, when the lock member L1 is attached to the long side wall 2, is positioned farther from the plate-like portion 2*a*) 20*a* of the bar-like member 20. A diven pin 20*c* is positioned near one of opposite side walls 20*b*.

The weight of the bar-like member 20 and the amount of material for the bar-like member 20 can be reduced by constructing the bar-like member 20 using the front plate 20*a*, an upper-end horizontal rib 20*d* extending in a horizontal direction from the upper end of the front plate 20*a*, and a lower-end horizontal rib 20*e* extending in the horizontal direction from the lower end of the front plate 20*a*. A space portion A3 is formed on a surface of the bar-like member 20 (which, when the block bar L1*b* is attached to the long side wall 2A, positioned on the plate-like portion 2*a* side) which is positioned on the plate-like portion 2*a* side. Furthermore, to reinforce the bar-like member 20, a vertical rib 20*f* or a horizontal rib 20*g* may be appropriately formed in the space portion A3.

Now, with reference to FIGS. 10 to 13, a description will be given of how the lock member L1 composed of the operation portion L1*a* and the pair of lock bars L1*b* is assembled to the long side wall 2A.

Figure 10:
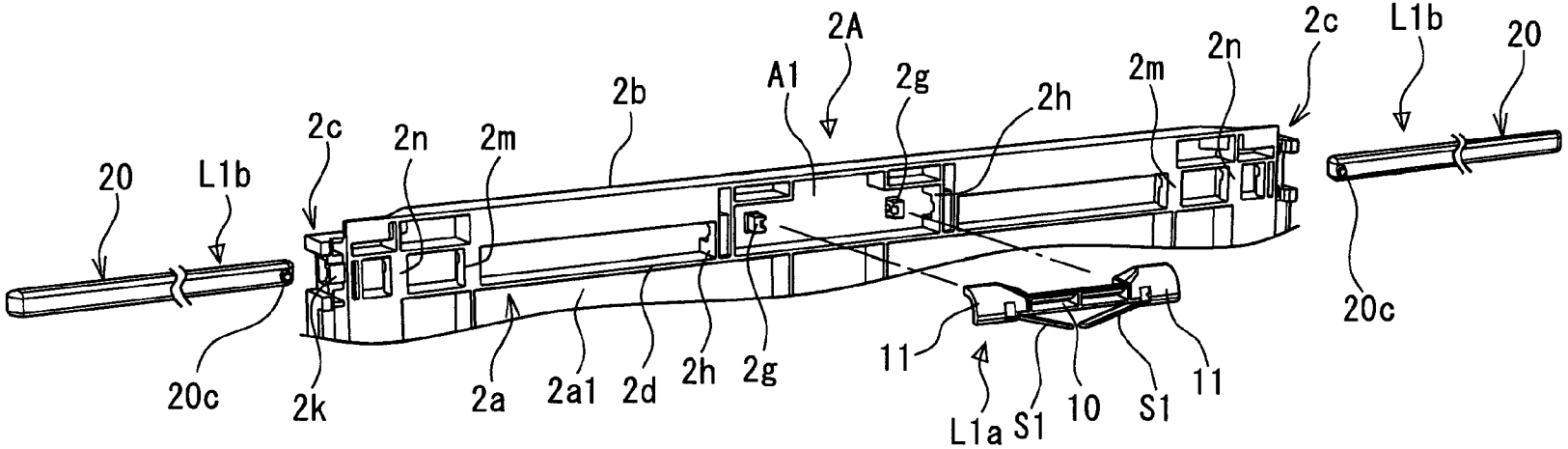
FIG. 10 is an exploded perspective view of the long side wall and the lock member included in the folding container according to the present invention.

First, as shown in FIG. 10, the lock member L1 is placed such that the coupling inclined wall 10*d* formed in the operation portion L1*a* lies opposite the outer surface 2*a*1 of the plate-like portion 2*a* forming the central space portion A1 formed in the long side wall 2A. Furthermore, each of the paired lock bars L1*b* is placed on the side of the corresponding long side wall-side engaging member 2*c* of the long side wall 2A. At this time, the driven pin 20*c* formed in the lock bar L1*b* is positioned on the long side wall 2A side.

Figure 11:
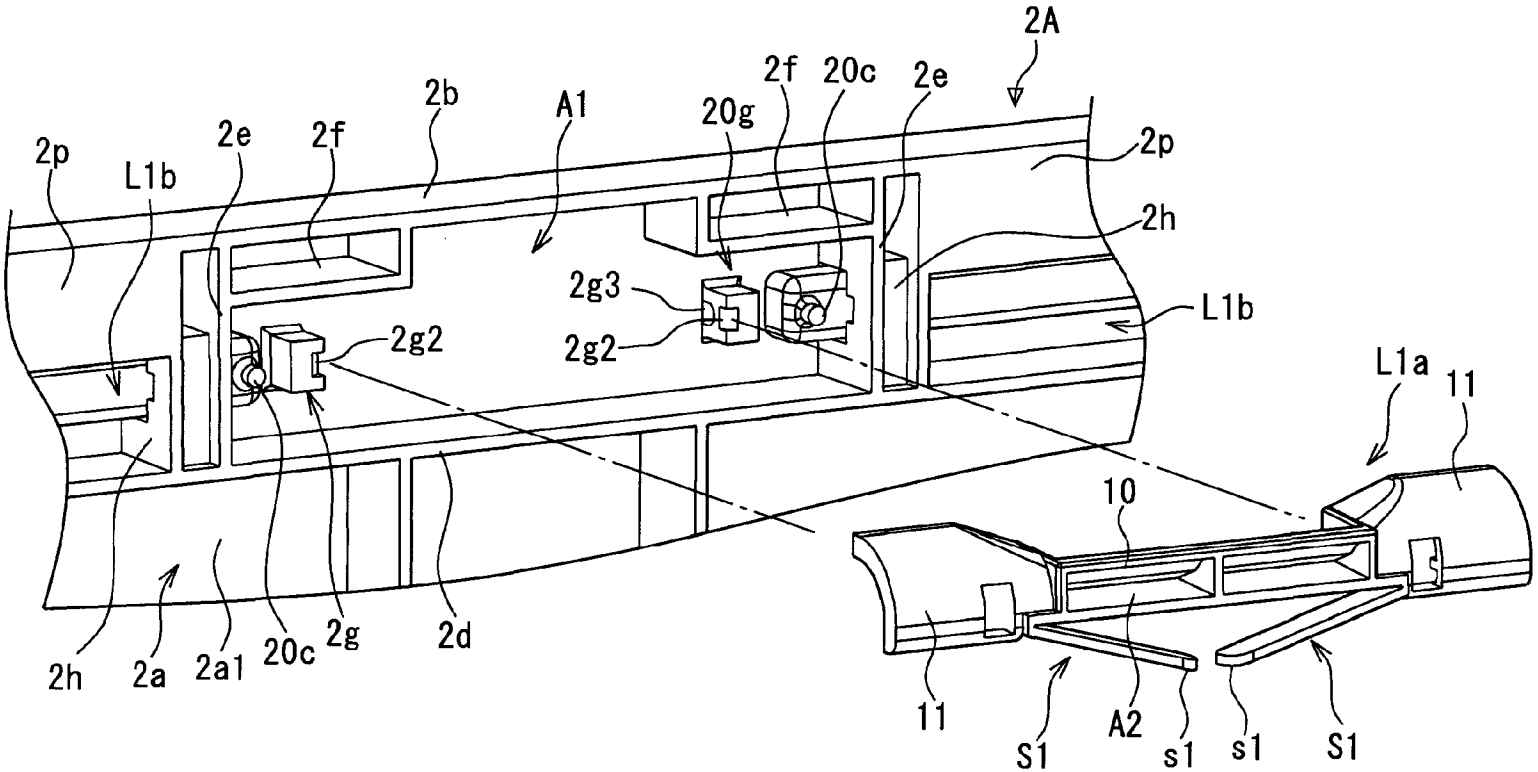
FIG. 11 is an exploded perspective view of the long side wall and the lock member included in the folding container according to the present invention.

Then, each of the lock bars L1*b* is moved in the horizontal direction toward the corresponding long side wall-side engaging member 2*c* formed on the long side wall 2A so as to direct the driven 20*c* of the lock bar L1*b* to the long side wall-side engaging member 2*c*. The lock bar L1*b* is thus inserted through the guiding through-holes H1 drilled in the terminal guide block 2*k* and terminal vertical rib 2*j* formed on the long side wall 2A, and the guiding through-holes H1 drilled in the intermediate guide blocks 2*m*, 2*n*, and through the guiding through-hole H1 drilled in the central guide block 2*h* and the central coupling vertical rib 2*e*. Thus, as shown in FIG. 11, the driven pin 20*c* of the lock bar L1*b* is positioned in the central space portion A1 formed in the long side wall 2A and close to the pivotal shaft supporting block 2*g*. When the lock bar L1*b* is inserted through the guiding through-holes H1, the bar-like member 20 of the lock bar L1*b* is inserted through the main guide insertion portion h1. Furthermore, the driven pin 20*c* of the lock bar L1*b* is inserted through the driven pin insertion portion h2.

Figure 13:
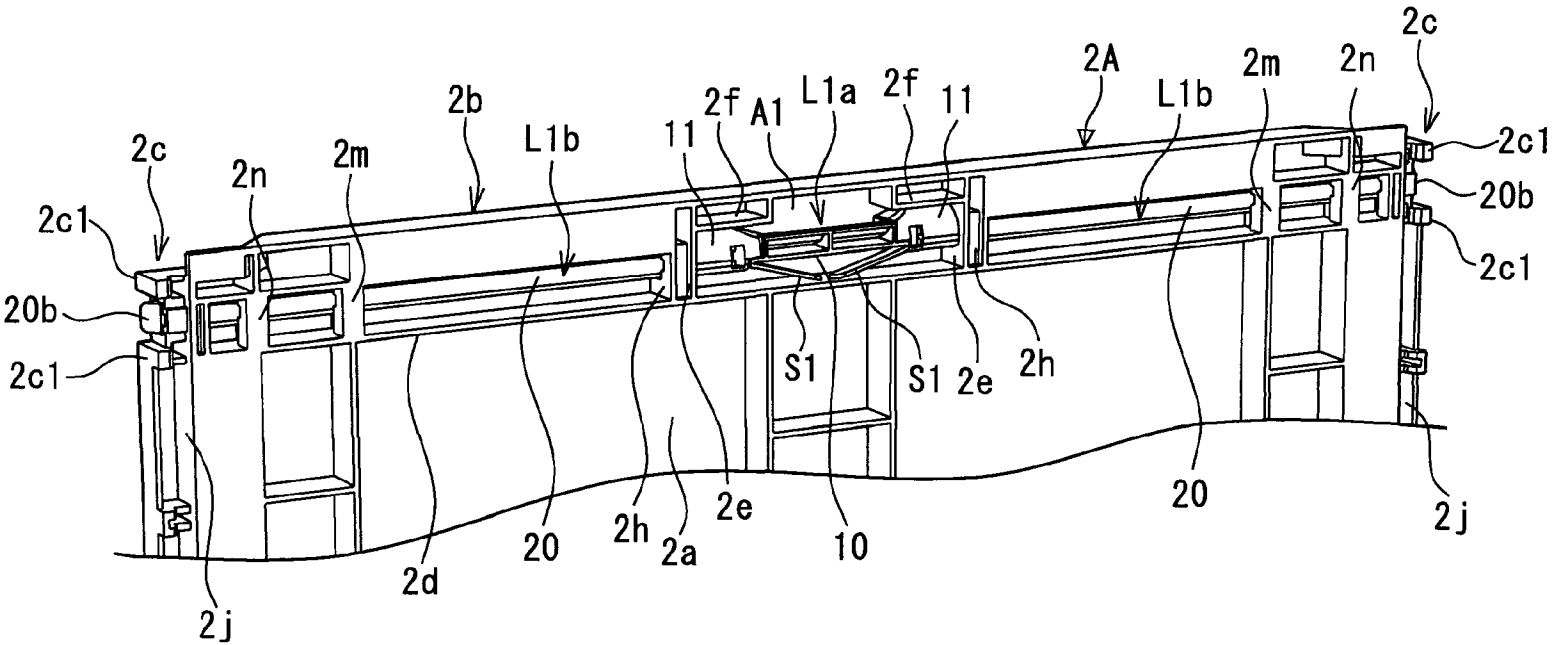
FIG. 13 is a partly enlarged perspective view showing that the lock member is assembled to the long side wall of the folding container according to the present invention.

Then, the operation portion L1*a* is moved closer to the plate-like portion 2*a* forming the central space portion A1 formed in the long side wall 2A. Thus, the pivotal shaft 13 of the operation portion L1*a* is allowed to abut against the guiding inclined surface 2*g*2 formed on the pivotal shaft supporting block 2*g* formed on the plate-like portion 2*a* of the long side wall 2A. Moreover, the operation portion L1*a* is moved closer to the plate-like portion 2*a* of the long side wall 2A. Then, the pivotal shaft 13 of the operation portion L1*a* moves closer to the plate-like portion 2*a* of the long side wall 2A while being guided along the guiding inclined surface 2*g*2 of the shaft pivotal-supporting block 2*g*. Finally, the pivotal shaft 13 of the operation portion L1*a* is fitted into the bearing holes 2*g*3 in the respective pivotal shaft bearing blocks 2*g*. Furthermore, the driven pin 20*c* on the lock bar L1*b* is inserted into the lower end of the cam groove 12A formed in the inner peripheral surface 11*a*2 of the segment member 11*a* of the operation portion L1*a*. In this manner, as shown in FIG. 13, the lock member L1 is assembled to the long side wall 2A. When the lock member L1 is assembled to the long side wall 2A, the tip s1 of each of the spring members S1 formed on the operation portion L1*a* approaches or abuts against the top surface of the upper horizontal rib 2*d* positioned in the central space portion A1.

As described above, with the lock member L1 assembled to the long side wall 2A, a tip portion of the lock bar L1*b* projects beyond the terminal guide block 2*k* of the long side wall 2A as shown in FIG. 13, and the tip portion of the lock bar L1*b* is positioned between the paired fitting projecting portions 2*c*1 formed in the long side wall-side engaging member 2*c*. The end side wall 20*b* forming the tip of the lock bar L1*b* is configured so as not to project beyond the long side wall 2A. This state of the lock member L1 is hereinafter referred to as the lock state of the lock member L1.

Now, the operation of the lock member L1 assembled to the long side wall 2A will be described with reference to FIGS. 14 to 17.

Figure 14:
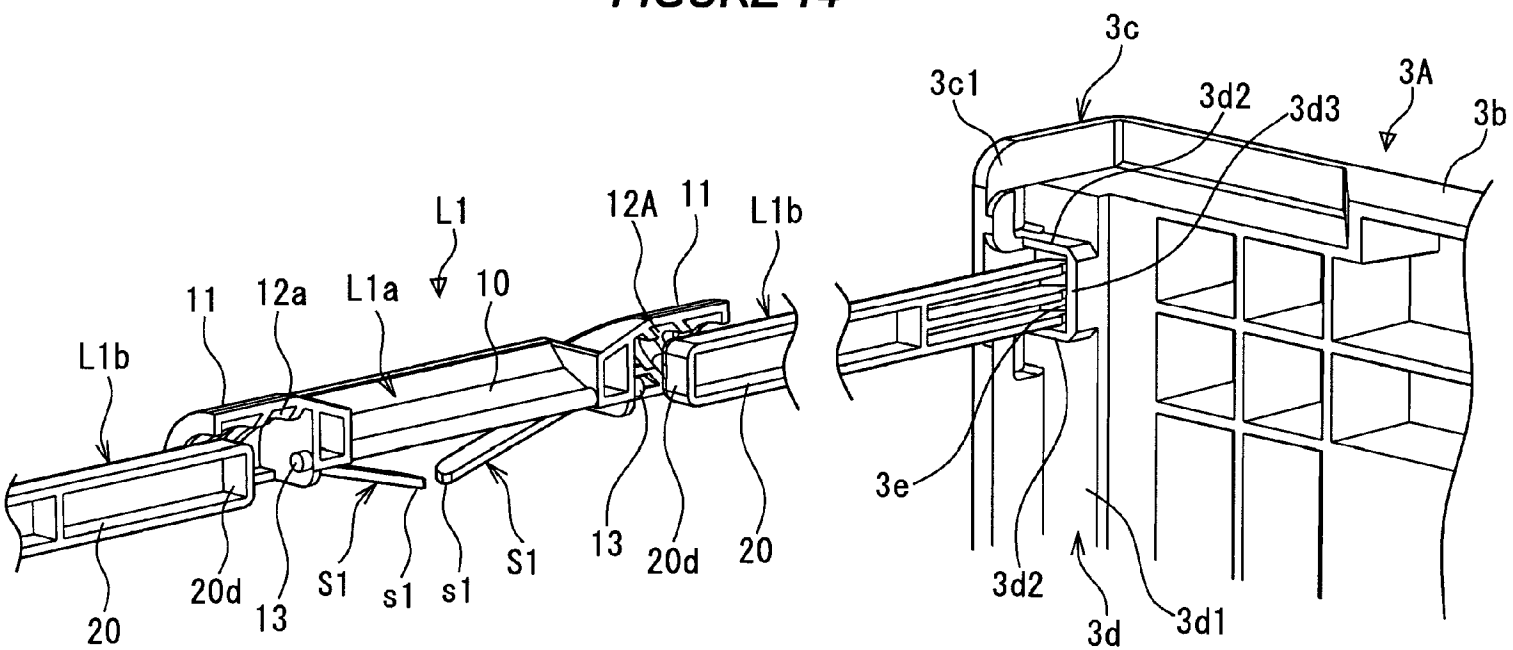
FIG. 14 is a partly enlarged perspective view showing that the short side wall is locked to the lock member assembled to the long side wall of the folding container according to the present invention.
Figure 15:
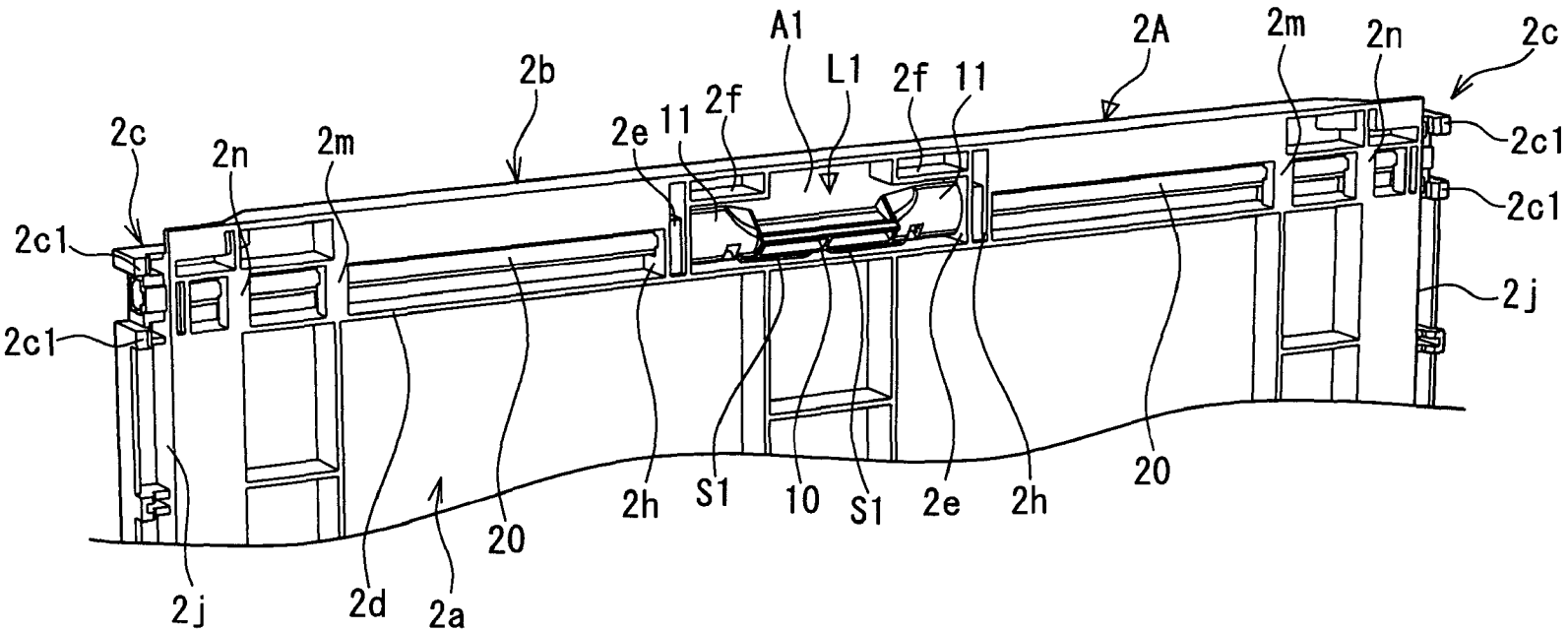
FIG. 15 is a partial perspective view showing that the lock member is assembled to the long side wall of the folding container according to the present invention.

When the folding container is in the assembled box form as shown in FIG. 1, the lock member L1 is in the lock state. In this state, the tip portion of the lock bar L1*b* is inserted in the engaging recess portion 3*e* formed in the short side wall-side engaging member 3*c* of the short side wall 3A as shown in FIG. 14. Furthermore, the fitting projecting portions 2*c*1 formed on the long side wall-side engaging member 2*c* of the long side wall 2A are fitted in the corresponding fitting holes 3*f* formed in the short side wall-side engaging member 3*c* of the short side wall 3A. Thus, the long side wall 2A is prevented from falling down toward the bottom portion 1 unless the lock state of the lock member L1 is cancelled as described below.

Figure 12:
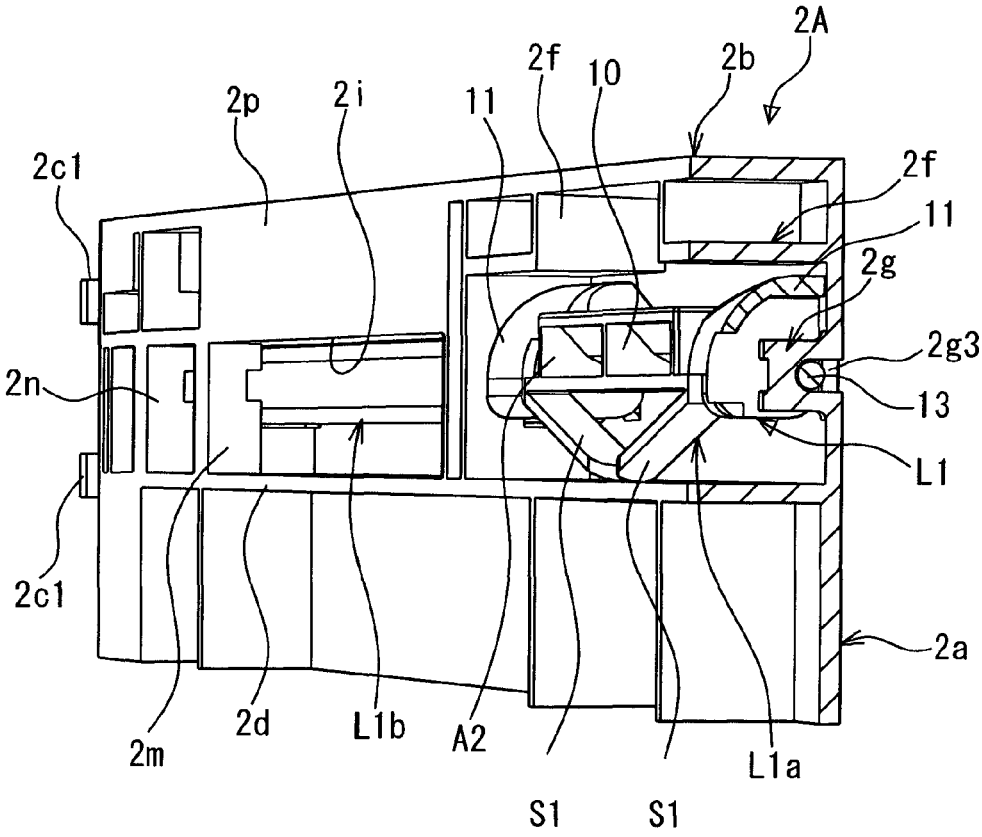
FIG. 12 is a partly enlarged perspective view including a partly sectional view and showing that the lock member is assembled to the long side wall of the folding container according to the present invention.
Figure 16:
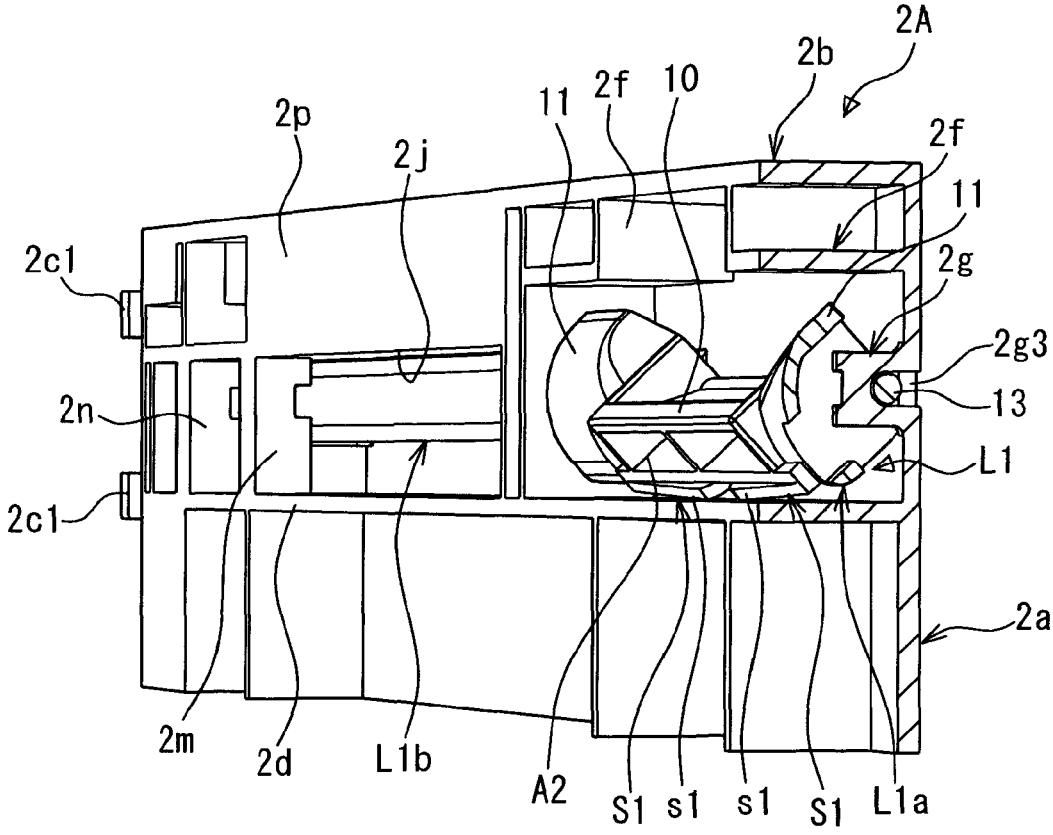
FIG. 16 is a partly enlarged perspective view including a partly sectional view and showing that the lock member is assembled to the long side wall of the folding container according to the present invention.

To fold the folding container assembled in the box form, the operator inserts the operator's finger in the operation space portion A2 of the operation portion L1*a* of the lock member L1 in the lock state as shown in FIGS. 12 and 13, and then pushes the lower-end horizontal beam 10*b* of the operation portion L1*a* downward. Then, the lower-end horizontal beam 10*b* of the operation portion L1*a* is pivotally moved closer to the upper horizontal rib 2*d*, using, as a pivotal point, the pivotal shaft 13 of the operation portion L1*a* fitted in the bearing holes 2*g*3 in the pivotal shaft supporting block 2*g* formed on the long side wall 2A (this pivotal moving direction is hereinafter simply referred to as the downward pivotal movement of the operation portion L1*a*). The downward pivotal movement of the operation portion L1*a* causes the spring members S1 formed on the operation portion L1*a* to be compressed against the elastic force thereof as shown in FIG. 16 (the following is hereinafter referred to as the compressed state of the spring member S1: the state in which the tip s1 of each of the spring members S1 is located close to the lower-end horizontal beam 10*b* of the operation portion L1*a*).

As described above, the downward pivotal movement of the operation portion L1*a* allows the driven pin 20*c* of each of the lock bars L1*b* inserted in the lower end of the corresponding cam groove 12A formed in the operation portion L1*a* to move to the upper end of the cam groove 12A. Thus, the paired lock bars L1*b* move closer to each other.

Figure 17:
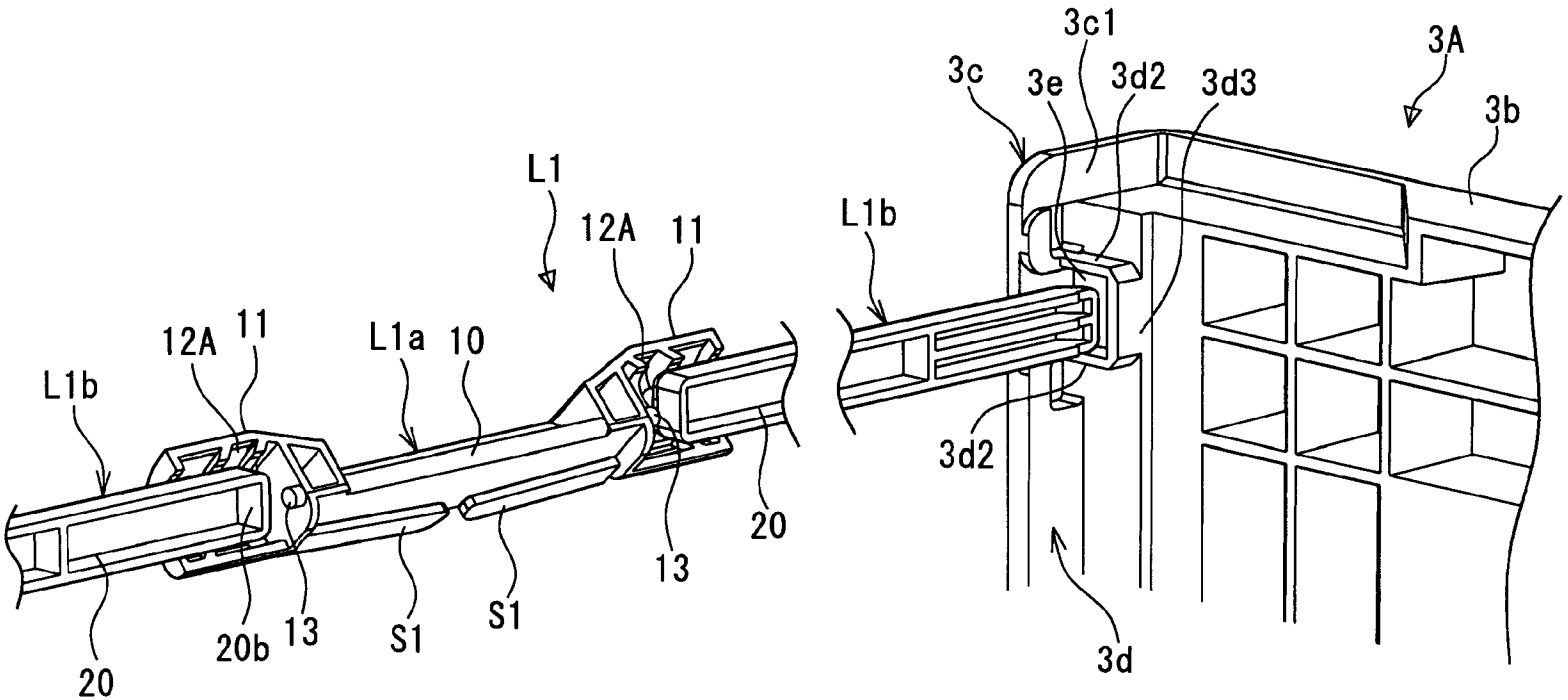
FIG. 17 is a partly enlarged perspective view illustrating that the short side wall is unlocked from the lock member assembled to the long side wall of the folding container according to the present invention.

As described above, when the operation portion L1*a* is pivotally moved downward to move the paired lock bars L1*b* closer to each other, the tip portion of the lock bar L1*b* inserted in the engaging recess portion 3*e* formed in the short side wall-side engaging member 3*c* of the short side wall 3A is removed from the engaging recess portion 3*e* as shown in FIG. 17. Thus, with the folding container assembled in the box form, the lock state in which the lock member L1 of the long side wall 2A locks the short side wall 3A is cancelled to allow the long side wall 2A to be brought down toward the bottom portion 1. Then, the short side wall 3A is brought down toward the bottom portion 1 to allow the folding container to be folded.

As described above, when the lock state established between the long side wall 2A and the short side wall 3A via the lock member L1 is cancelled, the upper-end horizontal beam 10*a* of the operation portion L1*a* is pivotally moved closer to the upper-end horizontal rib 2*b* by the elastic restoring force of the spring members S1, the pivotal shaft 13 of the operation portion L1*a* fitted in the bearing holes 2*g*3 in the pivotal shaft supporting block 2*g* formed on the long side wall 2A (this pivotal moving direction is hereinafter simply referred to as the upward pivotal movement of the operation portion L1*a*).

As described above, the locking and unlocking between the long side wall 2A and the short side wall 3A via the lock member L1 is performed by pivotally moving the operation portion L1*a* downward (the unlocking between the long side wall 2A and the short side wall 3A) or upward (locking between the long side wall 2A and the short side wall 3A) using, as a pivotal point, the pivotal shaft 13 of the operation portion L1*a* fitted in the bearing holes 2*g*3 in the pivotal shaft supporting block 2*g* formed on the long side wall 2A. Thus, even if the operator pushes a part of the lower-end horizontal beam 10*b* of the operation portion L1*a* which the part is positioned on the vertical-end wall 10*c* side, the operation portion L1*a* is prevented from being tilted. Therefore, the pair of lock bars L1*b* moved backward (toward the central portion of the long side wall 2A) by the downward pivotal movement of the operation portion L1*a* is simultaneously and reliably moved in the horizontal direction. Thus, the long side wall-side engaging members 2*c* arranged at the respective ends of the long side wall 2A can be reliably unlocked from the short side wall-side engaging members 3*c* arranged at the respective ends of the short side wall 3A via the lock member L1. This enables the solution of the problem with the conventional folding container that one of the lock bars L1*b* fails to be removed from the engaging recess portion 3*e* of the corresponding short side wall-side engaging members 3*c* of the short side wall 3A, preventing the long side wall 2A from being brought down toward the bottom portion 1.

Furthermore, even when the elastic restoring force of the spring members S1 causes the operation portion L1*a* to move pivotally upward, the pair of lock bars L1*b* moved forward (toward the terminal vertical rib 2*j* of the long side wall 2A) by the upward pivotal movement of the operation portion L1*a* is simultaneously and reliably moved.

Now, another embodiment of the present invention will be described with reference to FIGS. 18 to 21.

The present embodiment uses coil-like spring members (hereinafter simply referred to as coil springs) instead of the flat plate-like spring members S1 hanging from the bottom surface of the lower-end horizontal beam 10*b* of the operation main body 10 included in the operation portion L1*a* in the above-described embodiment. Furthermore, in order to allow such coil springs S2 to be used, the operation portion L1*a* is modified as follows.

Figure 19:
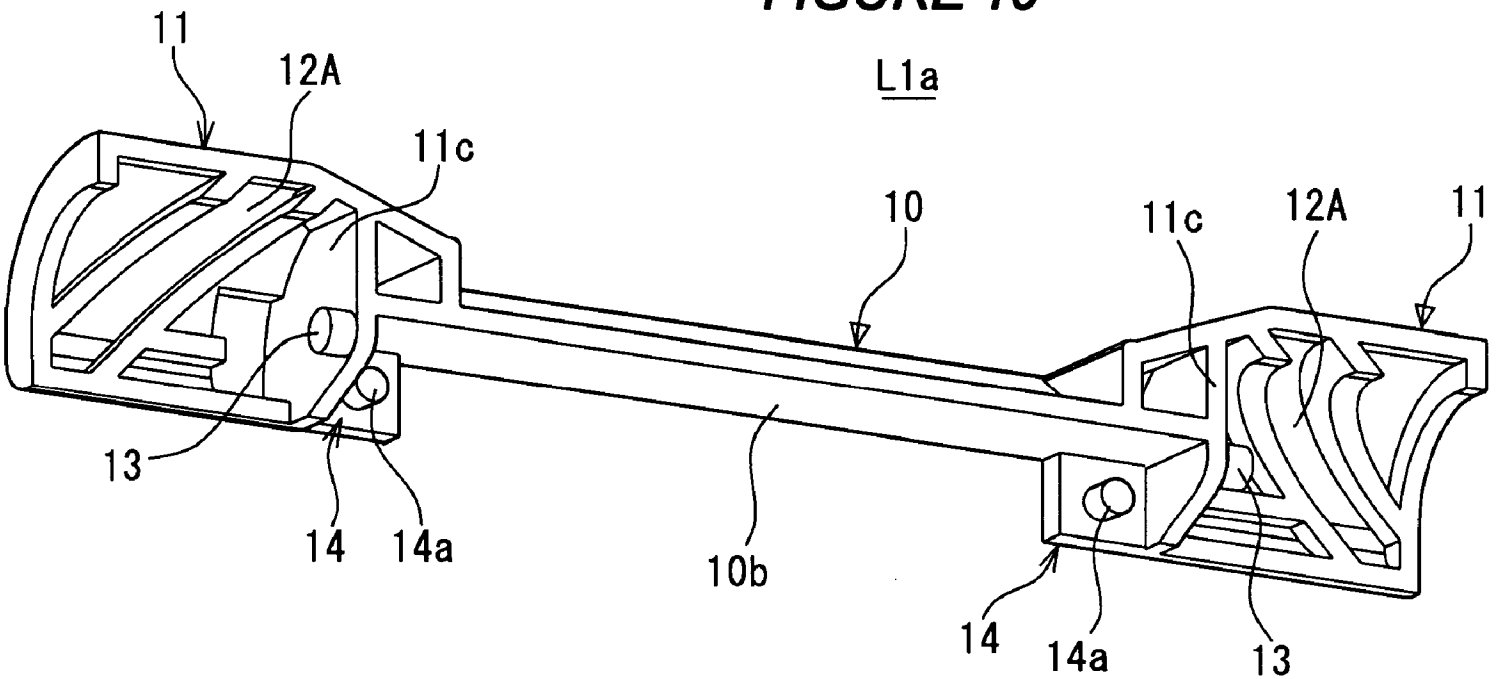
FIG. 19 is a perspective view of an operation portion included in the lock member according to the embodiment shown in FIG. 18.

As shown in FIG. 19, in the present embodiment, as described above, the flat plate-like spring members S1 are omitted which hang from the lower-end horizontal beam 10*b* of the operation main body 10 included in the operation portion L1*a* in the above-described embodiment. In the present embodiment, a coil spring supporting plate 14 is formed in a corner portion formed by the partitioning wall 11*c* and the lower-end horizontal beam 10*b* of the operation main body 10. Furthermore, a coil spring supporting pin 14*a* is projected from a rear surface (which, when the lock member L1 is attached to the long side wall 2A, is positioned on the plate-like portion 2*a* side) of the coil supporting plate 14 so that one end of the coil spring S2 can be inserted around the coil spring supporting pin 14*a*.

Figure 18:
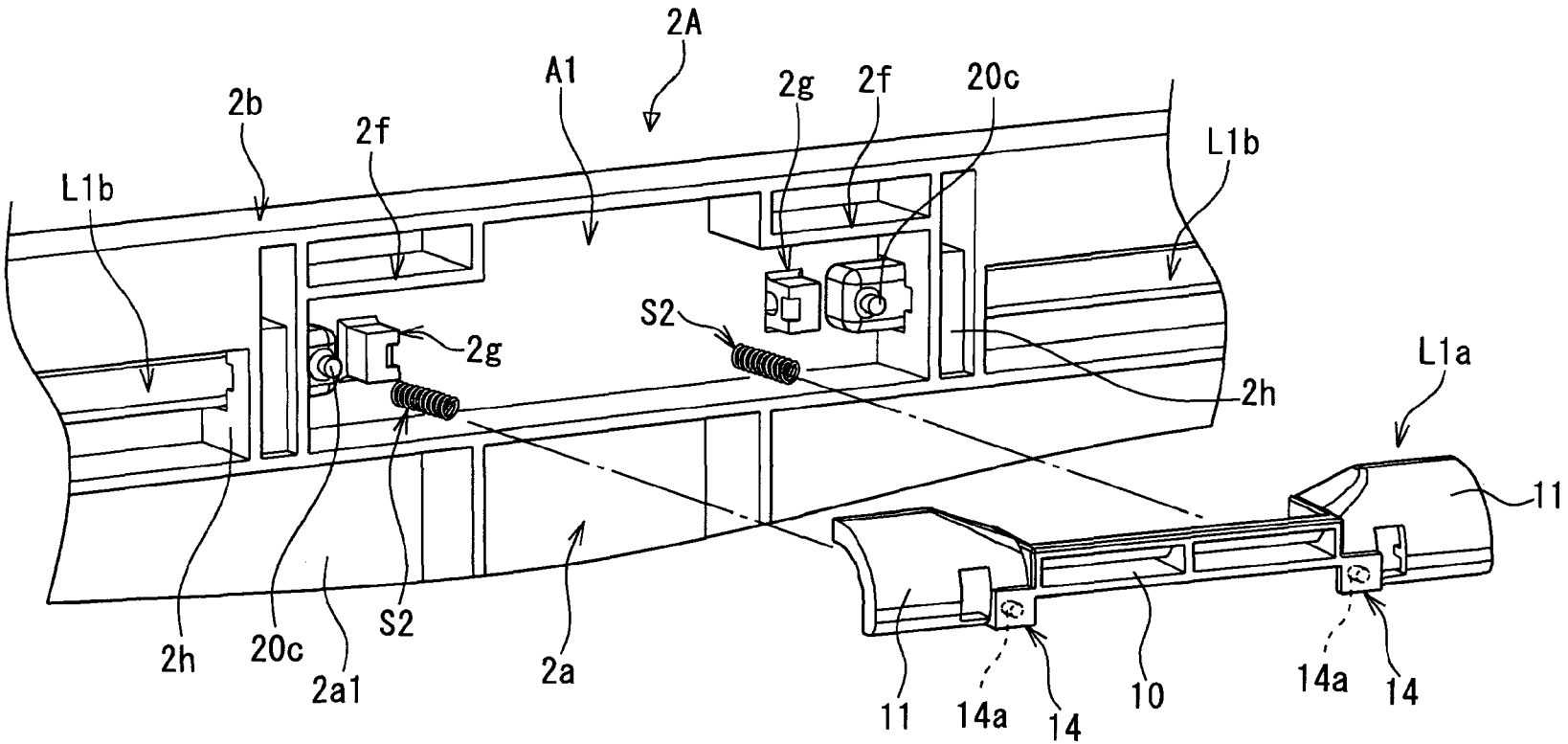
FIG. 18 is an exploded perspective view of a long side wall and a lock member included in a folding container according to another embodiment of the present invention.

As shown in FIG. 18, one end of the coil spring S2 is inserted around the coil spring supporting pin 14*a*. Then, as in the above-described embodiment, the operation portion L1*a* included in the lock member L1 is placed opposite the outer surface 2*a*1 of the plate-like portion 2*a* of the long side wall 2A. Thereafter, the operation portion L1*a* is moved closer to the long side wall 2A and thus assembled to the long side wall 2A as in the case of the above-described embodiment.

Figure 20:
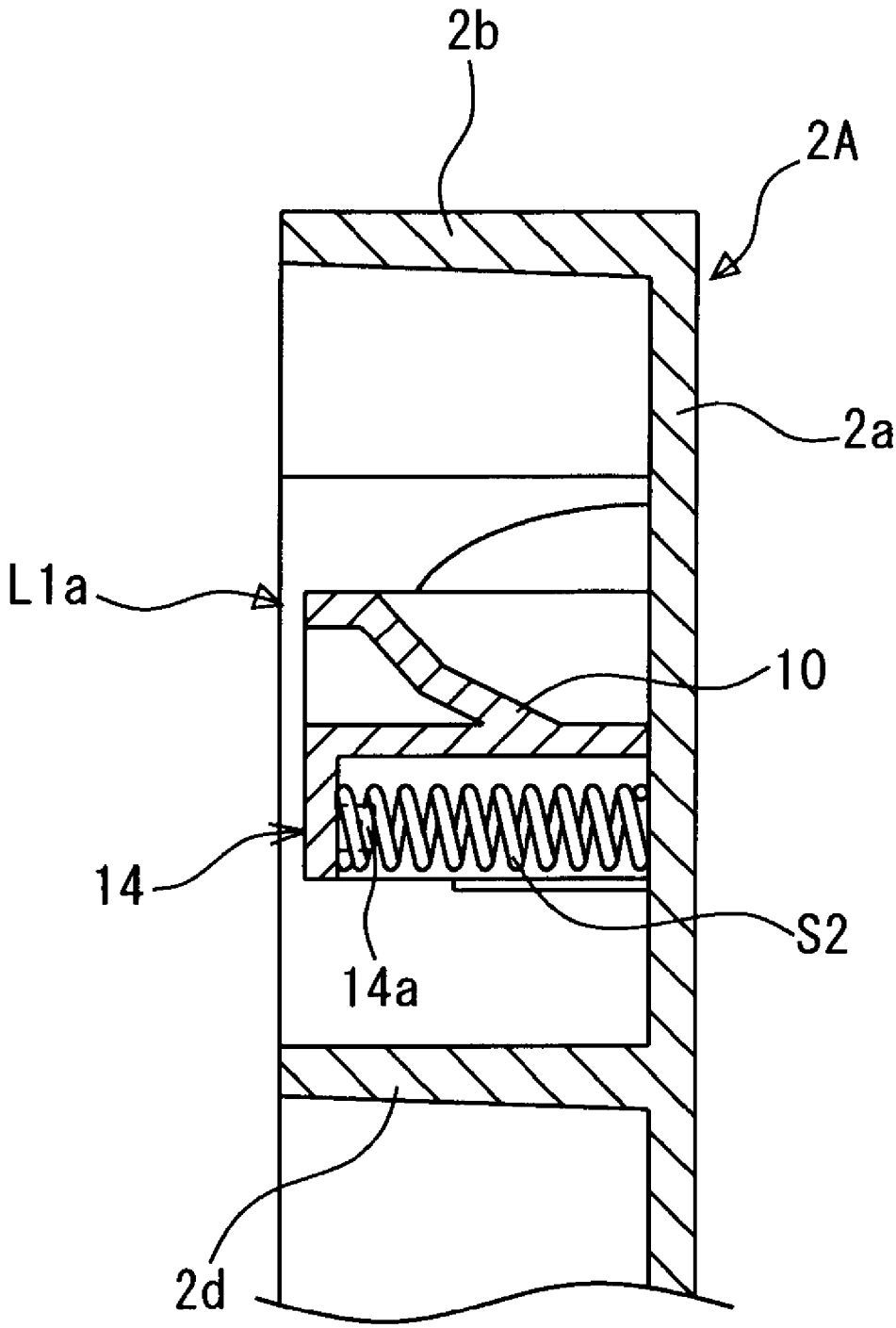
FIG. 20 is a partly enlarged sectional view perpendicular to a plate-like portion of the long side wall with the lock member assembled thereto in the embodiment shown in FIG. 18.
Figure 21:
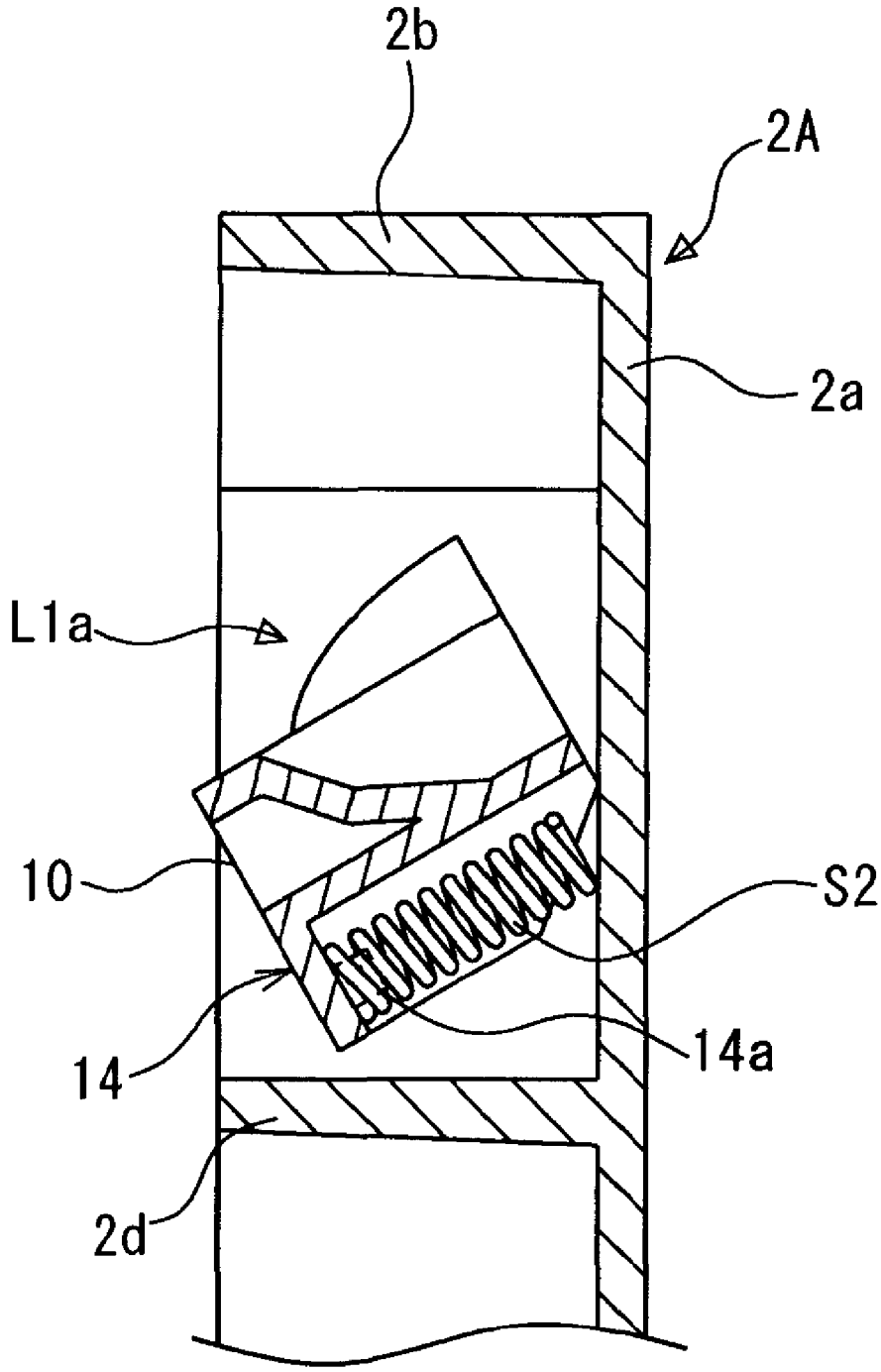
FIG. 21 is, like FIG. 20, a partly enlarged sectional view perpendicular to the plate-like portion of the long side wall with the lock member assembled thereto in the embodiment shown in FIG. 18.

As shown in FIG. 20, with the lock member L1 in the lock state, the coil springs S2 are expanded. Furthermore, when the operation portion L1*a* is pivotally moved downward for unlocking, the coil springs S2 are compressed as shown in FIG. 21. When the operator takes the operator's hand off the operation portion L1*a*, the operation portion L1*a* is pivotally moved upward by the restoration force of the coil springs S2.

Figure 22:
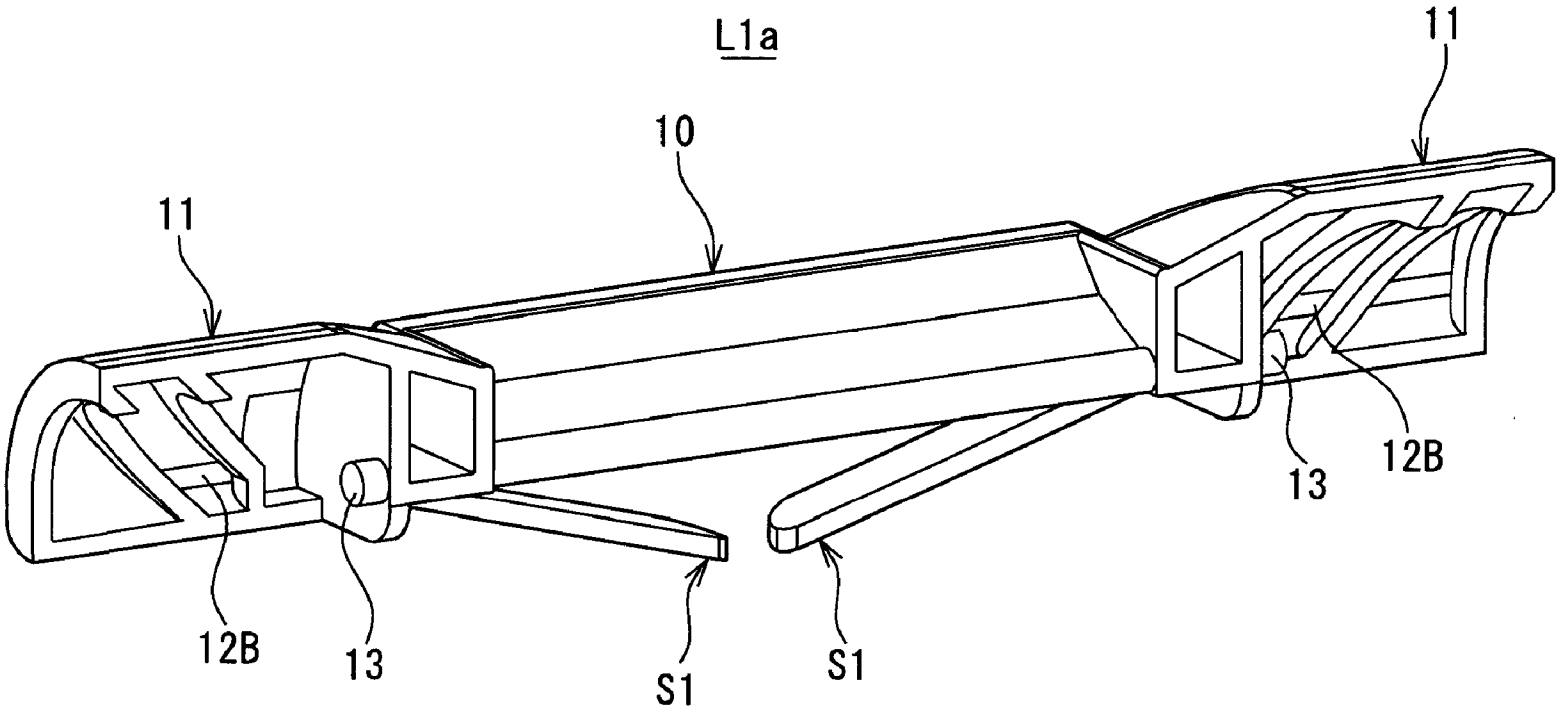
FIG. 22 is a perspective view of an operation portion of a lock member included in a folding container according to yet another embodiment of the present invention.

Now, another embodiment of the present invention will be described with reference to FIGS. 22 to 24.

Figure 7:
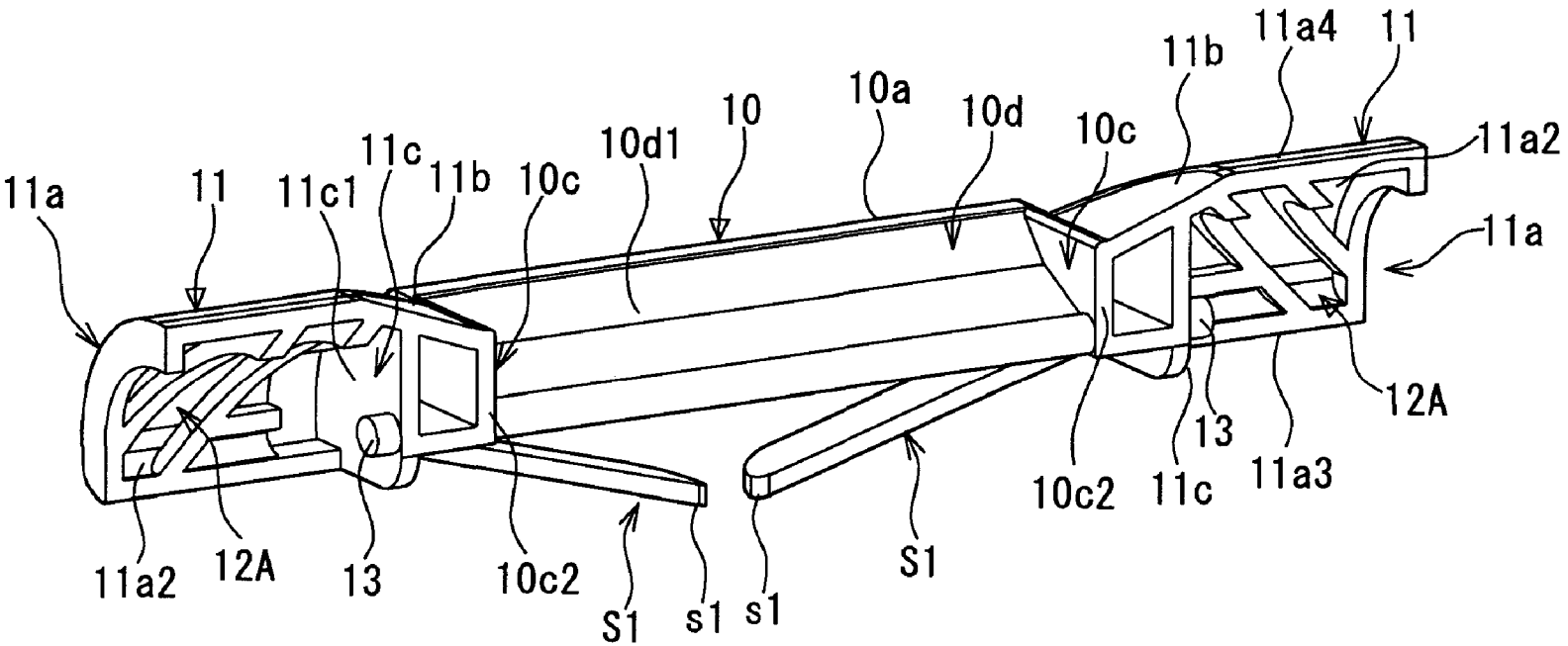
FIG. 7 is, like FIG. 6, a perspective view of the operation portion of the lock member included in the folding container according to the present invention.

In the above-described embodiments, as shown in FIG. 7, the cam groove 12A formed in the inner peripheral surface 11*a*2 of the segment member 11*a* included in the lock member L1 extends from the lower end 11*a*3 to upper end 11*a*4 of the segment member 11*a* and gradually toward the partitioning wall 11*c*. However, in the present embodiment, a cam groove 12B is formed so as to extend from the lower end 11*a*3 to upper end 11*a*4 of the segment member 11*a* and gradually away from the partitioning wall 11*c*.

Furthermore, when the operation portion L1*a* is pivotally moved upward, the driven pin 20*c* of the lock bar L1*b* included in the lock member L1 is inserted into the lower end of the cam grove 12B. In this state, when the operation portion L1*a* is pivotally moved downward, the driven pin 20*c* of the lock bar L1*b* is moved to the upper end of the cam groove 12B. Thus, the paired lock bars L1*b* move away from each other.

Figure 23:
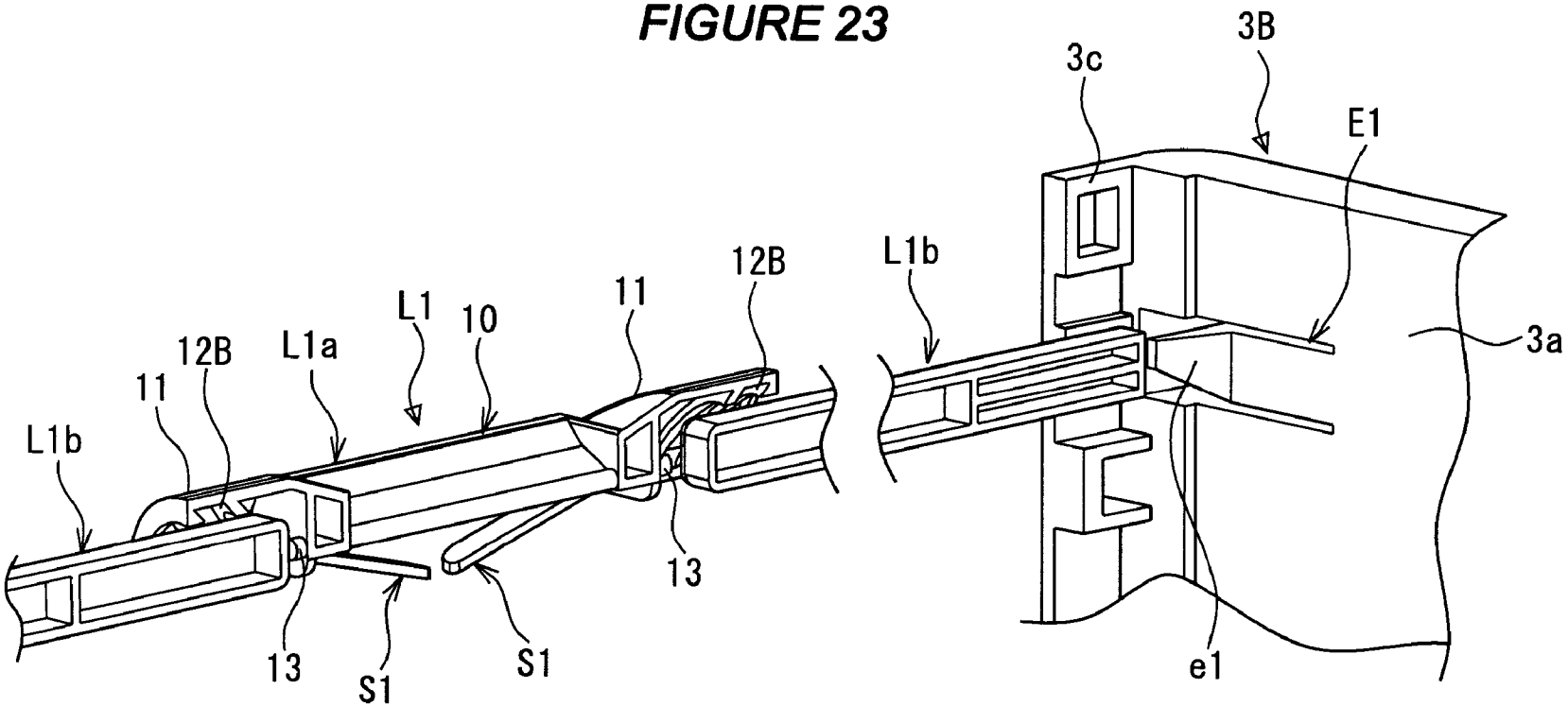
FIG. 23 is a partly enlarged perspective view illustrating that a short side wall is locked to the lock member assembled to a long side wall according to the yet another embodiment shown in FIG. 22.
Figure 24:
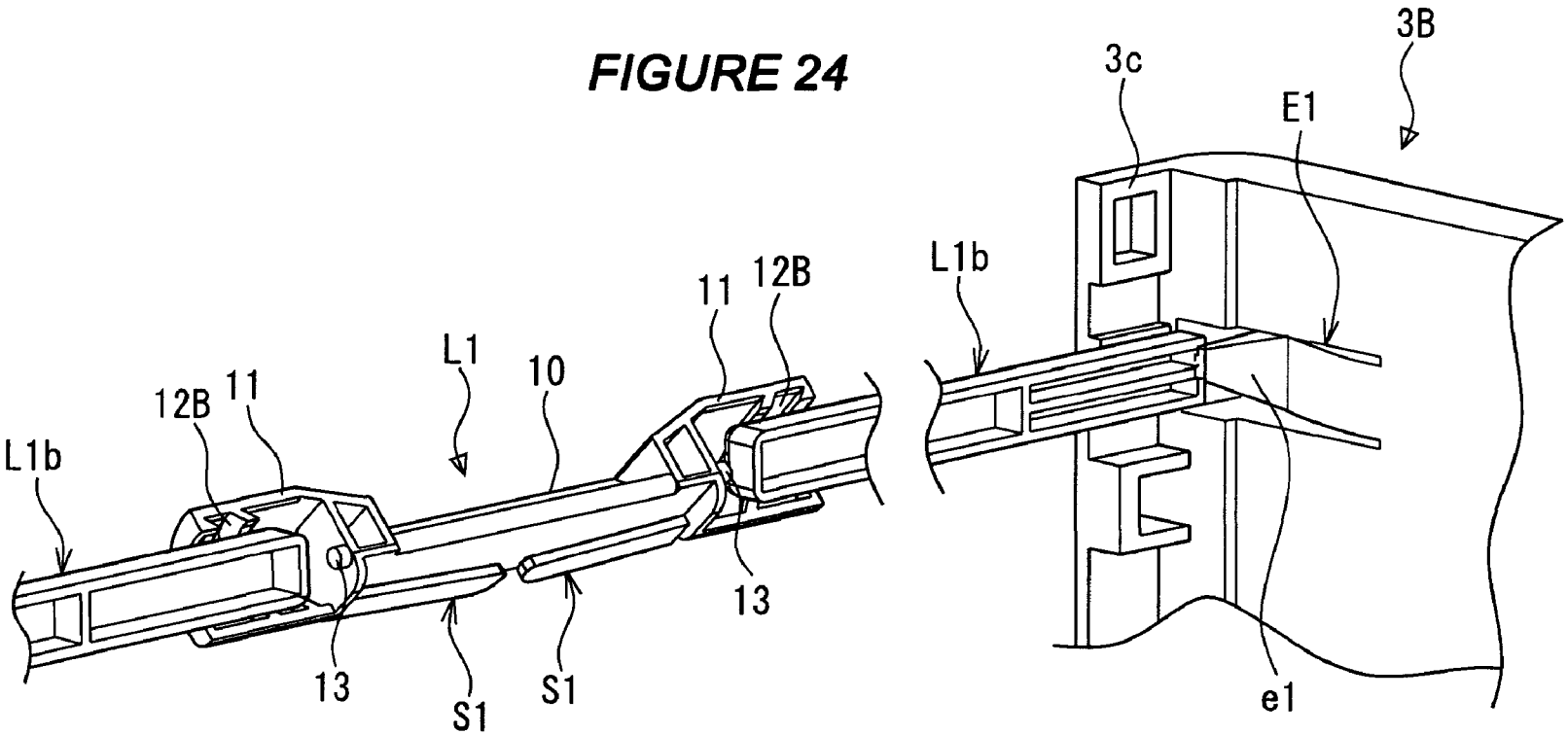
FIG. 24 is, like FIG. 23, a partly enlarged perspective view illustrating that the short side wall is unlocked from the lock member assembled to a long side wall according to the yet another embodiment shown in FIG. 22.

As shown in FIG. 23, this folding container is applicable to a folding container of a type in which an elastic piece E1 having a projecting portion e1 projected therefrom is formed on the plate-like portion 3*a* of the short side wall 3B. Since a folding container of this type is well known (for example, the Unexamined Japanese Patent Application Publication (Tokkai) No. 2004-51199), the configuration of the folding container itself is omitted.

As shown in FIG. 23, with the operation portion L1*a* pivotally moved upward (lock state), the paired lock bars L1*b* are prevented from abutting against the elastic piece E1. Furthermore, with the operation portion L1*a* pivotally moved downward, the paired lock bars L1*b* move away from each other to allow the end side wall 20*b* forming the tip of the lock bar L1*b* to abut against the projecting portion e1 of the elastic piece E1. Thus, as shown in FIG. 24, the elastic piece E1 is elastically deformed outward, thus in the folding container assembled in the box form, unlocking, from the elastic piece E1, a locking piece (not shown in the drawings) formed on the long side wall-side engaging member 2*c* of the long side wall 2A placed between the short side wall-side engaging member 3*c* of the short side wall 3B and the projecting portion e1 of the elastic piece E1. As a result, the long side wall 2A can fall down to the bottom portion 1.

Now, yet another embodiment will be described with reference to FIGS. 25 to 29.

The long side wall 2B has a plate-like portion 200*a* similar to the plate-like portion 2*a* in the above-described embodiment. An upper-end horizontal rib 200*b* similar to the upper-end horizontal rib 2*b* in the above-described embodiment is formed at the upper end of the long side wall 2B. Furthermore, a long side wall-side engaging member 200*c* is formed at each of the opposite vertical ends of the long side wall 2B so as to extend in the direction of the plate-like portion 200*a* and outward from a terminal vertical rib 200*j* similar to the terminal vertical rib 2*j* in the above-described embodiment. Fitting projecting portions 200*c*1 are formed at the upper end of the long side wall-side engaging member 200*c* at a predetermined distance from each other and substantially perpendicularly to the plate-like portion 200*a* so as to extend toward an outer surface (which, when the folding container is assembled into a box form, is positioned outside the assembled folding container) 200*a*1 of the plate-like portion 200*a*. Moreover, an upper horizontal rib 200*d* is formed on the upper portion of the plate-like portion 200*a* at a predetermined distance from the upper-end horizontal rib 200*b* so as to connect the terminal vertical ribs 200*j* together.

Paired opposite central coupling vertical ribs 200*e* are formed at a predetermined distance from each other so as to couple a central area of the upper-end horizontal rib 200*b* and a central area of the upper horizontal rib 200*d* together. A central space portion A10 is formed by the upper-end horizontal rib 200*b*, the upper horizontal rib 200*d*, the opposite paired central coupling vertical ribs 200*e*, and the outer surface 200*a*1 of the plate-like portion 200*a*.

A lever slit 200*e*1 serving as a lever support point for a lock bar L100*b* included in a lock bar L100 described below is drilled in the central coupling vertical rib 200*e*.

Furthermore, intermediate-end-side coupling vertical ribs 200*m* coupling the upper-end horizontal rib 200*b* and the upper horizontal rib 200*d* together is formed closer to the respective terminal vertical ribs 200*j* than the corresponding central coupling vertical ribs 200*e*. A slit 200*m*1 is drilled in each of the intermediate end-side coupling vertical ribs 200*m* so that the lock bar L100*b* included in the lock member L100 described below can be moved through the slit 200*m*1 in the vertical direction.

Moreover, a slit 200 *j*1 is also drilled at the upper end of the terminal vertical rib 200*j* so that the lock bar L100*b* included in the lock member L100 described below can be moved through the slit 200*j*1 in the vertical direction.

Figure 26:
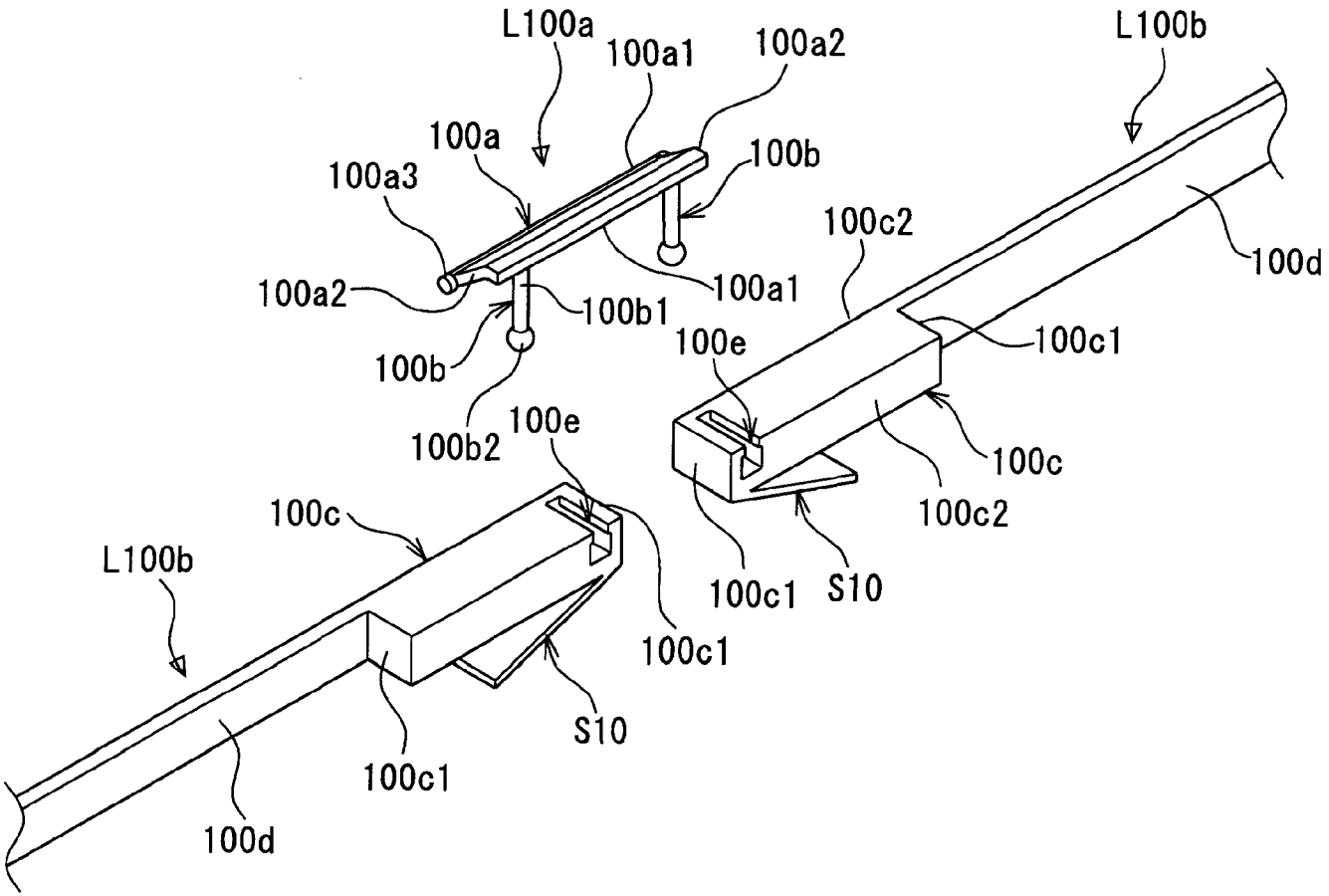
FIG. 26 is an exploded perspective view of a lock member assembled into the folding container shown in FIG. 25.

Now, the lock member L100 composed of the operation portion L100*a* and the lock bar L100*b* will be described with reference to FIGS. 26 and 27.

The operation portion L100*a* has a rectangular plate-like base portion 100*a*, and paired operation bars 100*b* provided on the bottom surface of the plate-like base portion 100*a* along a long-side end surface 10*a*1 of the plate-like base portion 100*a* and at a predetermined distance from each other so as to extend in the vertical direction. The operation bar 100*b* has a columnar portion 100*b*1 connected to the bottom surface of the plate-like base portion 100*a*, and a spherical operation end 100*b*2 formed at the tip of the columnar portion 100*b*1. The outer diameter of the operation end 100*b*2 is formed to be larger than the thickness of the columnar portion 100*b*1. Furthermore, a pivotal shaft 100*a*3 is projected from opposite short-side end surface 100*a*2 of the plate-like base portion 100*a*.

The lock bar L100*b* is composed of a flat prismatic block base portion 100*c*, and a vertical, flat plate-like plate portion 100*d* coupled to one of opposite vertical surfaces 100*c*1 of the block base portion 100*c*. Furthermore, a plate-like spring member S10 inclined toward the plate portion 100*d* hangs from the bottom surface of each of the block base portions 100*c*.

A cam groove 100*e* is formed in the upper portion of each of the block base portion 100*c* at a position located opposite the operation plate portion 100*d*, so as to extend from one of opposite long-side vertical surfaces 100*c*2 of the block base portion 100*c* toward the other long-side vertical surface 100*c*2 but not to reach the other long-side vertical surface 100*c*2. The cam groove 100*e* is formed parallel to the short-side vertical surface 100*c*1 of the block base portion 100*c*.

Figure 27:
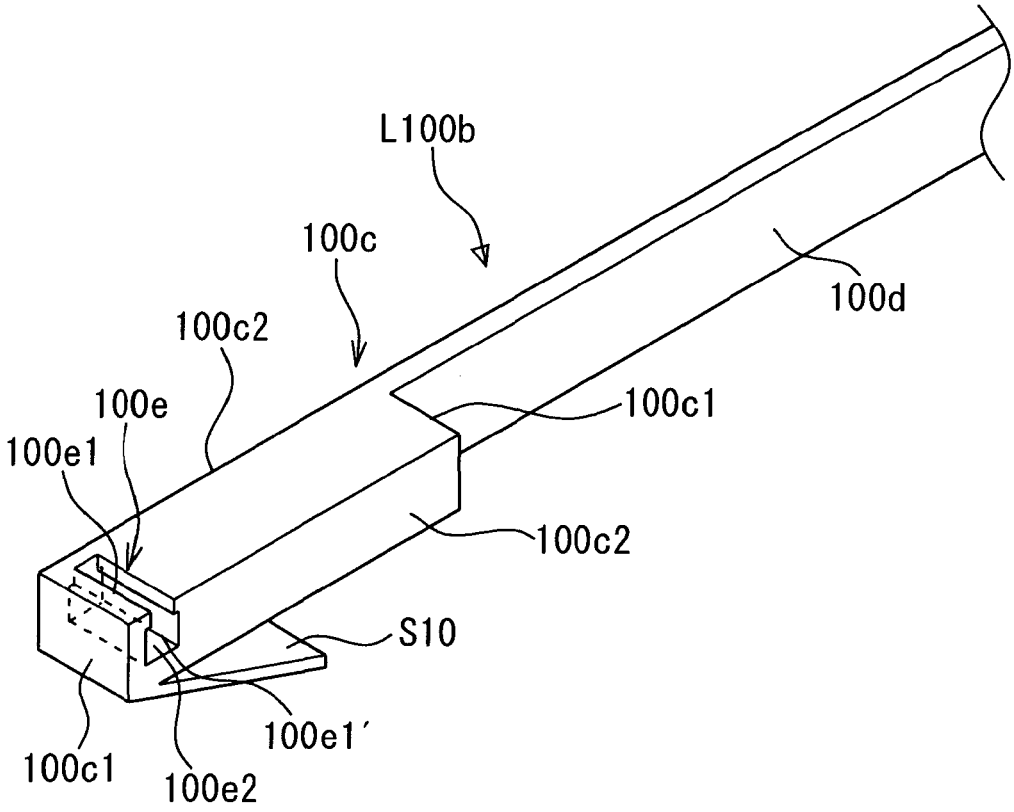
FIG. 27 is a partly enlarged perspective view of a lock bar included in the lock member assembled into the folding container shown in FIG. 25.

As shown in FIG. 27, the cam groove 100*e* is composed an operation end fitting portion 100*e*2 formed in the lower portion of the cam groove 100*e* and in which the operation end 100*b*2 of the operation bar 100*b* can be fitted, and a columnar fitting portion 100*e*1 in which the columnar portion 100 b1 of the operation bar 100*b* is fitted and guided. The cam groove 100*e* is formed so as to appear a reversed T-shape as viewed from the long-side vertical surface 100*c*2.

Support pieces 200*f* are provided in a central region of the bottom surface of the upper-end horizontal rib 200*b* of the long side wall 2B at a predetermined distance from each other so as to hang therefrom orthogonally to the longitudinal direction of the upper-end horizontal rib 200*b*. A pivotal-supporting hole 200*f*1 is formed in each of the support pieces 200*f* so that the pivotal shaft 100*a*3 projected from the above-described operation portion L100*a* is fitted and pivotally supported in the pivotal-supporting hole 200*f*1.

To assemble the lock member L100 to the long side wall 2B, the plate portion 100*d* of the lock bar L100*b* is inserted, from the central coupling vertical rib 200*e* side, firstly through the lever slit 200*e*1 drilled in the central coupling vertical rib 200*e*. The plate portion 100*d* is thereafter inserted through the slit 200*m*1 drilled in the intermediate-end coupling vertical rib 200*m*. The plate portion 100*d* is further inserted through the slit 200*j*1 drilled in the terminal vertical rib 200*j*. Thus, the plate portion 100*d* is inserted through the lever slit 200*e*1 drilled in the central coupling vertical rib 200*e*, also through the slit 200*m*1 drilled in the intermediate-end coupling vertical rib 200*m*, and further through the slit 200*j*1 drilled in the terminal vertical rib 200*j*. Then, the block base portions 100*c* of the paired lock bar L100*b* are arranged in the central space portion A10 formed by the upper-end horizontal rib 200*b*, the upper horizontal rib 200*d*, the opposite paired central coupling vertical ribs 200*e*, and the outer surface 200*a*1 of the plate-like portion 200*a*. In this state, the tip of the each of the spring members S10 abuts against or is positioned close to the upper horizontal rib 200*d*.

Then, the operation portion L100*a* is moved closer to the outer surface 200*a*1 of the plate-like portion 200 of the long side wall 2B. Thus, the operation end 100*b*2 of the operation bar 100*b* is inserted into the operation end fitting portion 100*e*2 of the cam groove 100*e*. Furthermore, the columnar portion 100*b*1 of the operation bar 100*b* is inserted into the columnar fitting portion 100*e*1 of the cam groove 100*e*. Thus, the lock member L100 is assembled to the long side wall 2B. As described above, when the lock member L100 is assembled to the long side wall 2B, the operation bar 100*b* of the operation portion L100*a* is positioned in an opening side of the cam groove 100*e*. Furthermore, the pivotal shaft 100*a*3 projected from the opposite short-side end surfaces 100*a*2 of the plate-like base portions 100*a* of the operation portion L100*a* is fitted into the pivotal-supporting holes 200*f*1 formed in the opposite surfaces of the support pieces 200*f* provided on the bottom surface of the upper-end horizontal rib 200*b* of the long side wall 2B at the predetermined intervals from each other so as to hang downward.

Figure 25:
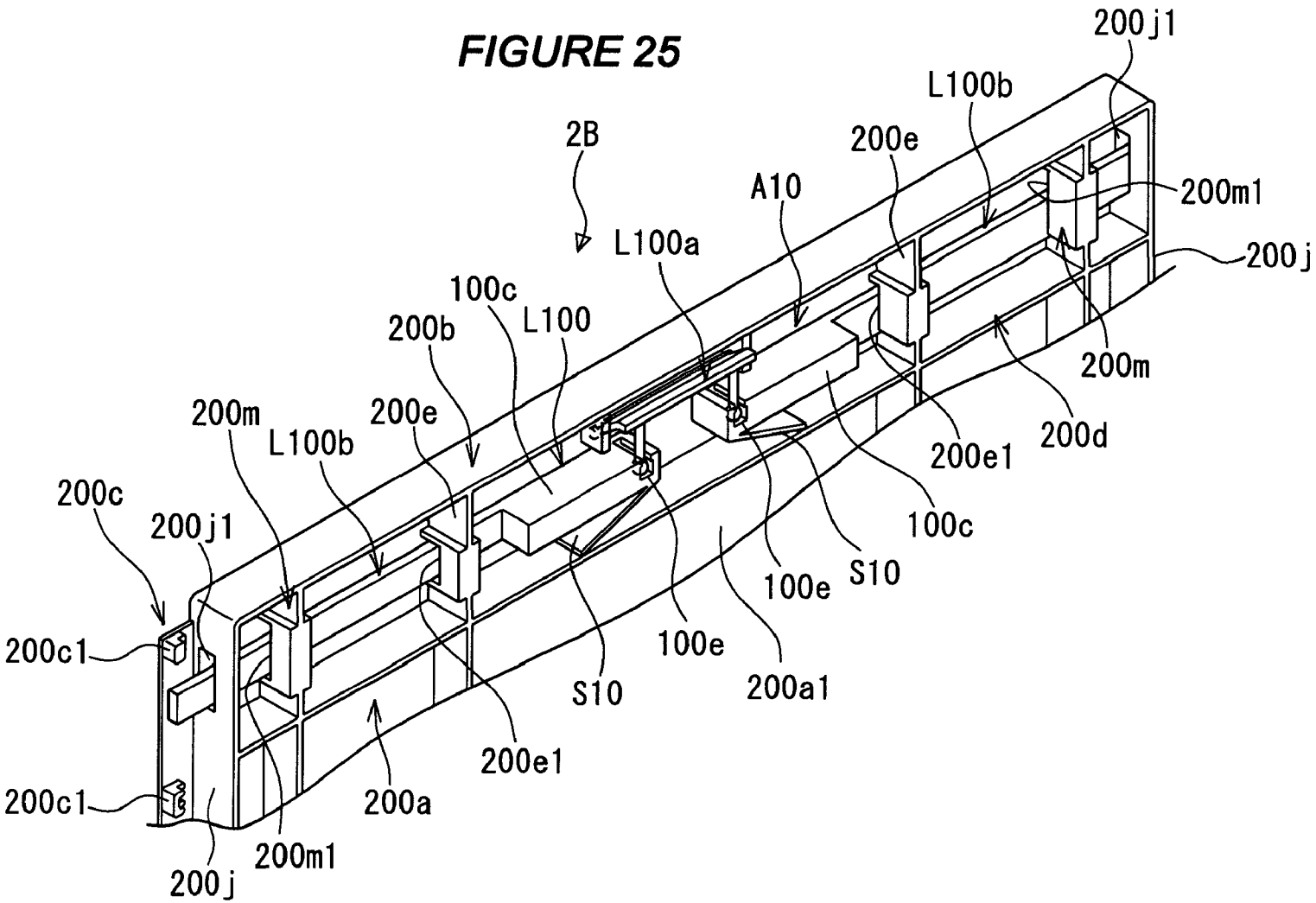
FIG. 25 is a partial perspective view of a long side wall included in a folding container according to still another embodiment of the present invention.
Figure 28:
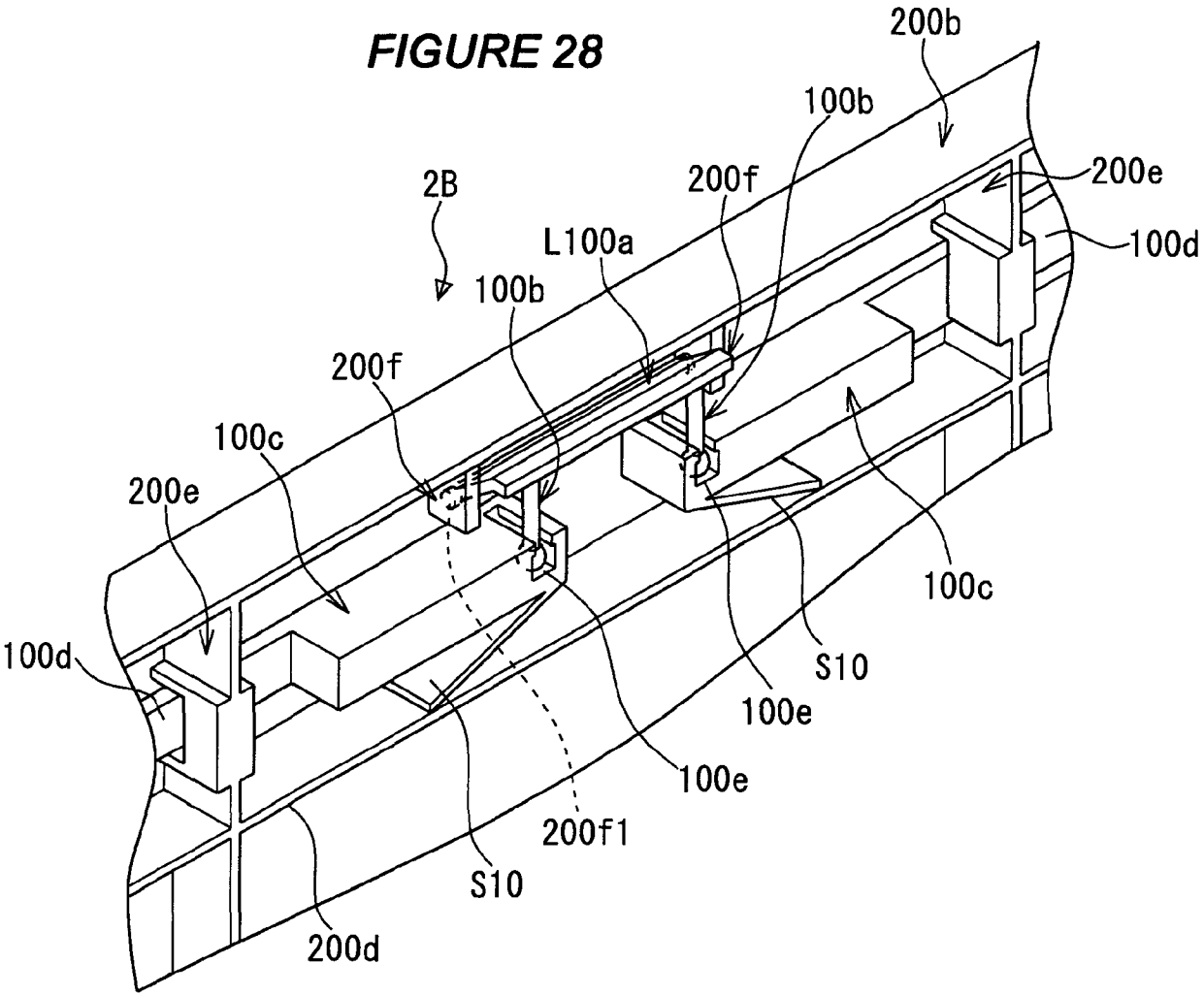
FIG. 28 is a partly enlarged perspective view of the lock member assembled into the folding container shown in FIG. 25.

As described above, when the lock member L100 is assembled to the long side wall 2B, the operation end 100*b*2 of each of the lock bars L100*b* abuts against or is positioned close to the bottom surface 100*e*1' of the operation end fitting portion 100*e*2 of the cam groove 100*e*. Furthermore, as shown in FIGS. 25 and 28, the plate portions 100*d* of the lock bar L100*b* are horizontally held. In this state, the tip of each of the spring members S10 abuts against or is positioned close to the upper horizontal rib 200*d*.

The above-described state is the lock state in which each of the lock bars L100*b* of the lock member L100 is locked in the locking portion (not shown in the drawings) formed in the short wall-side engaging member 3*c* of the short side wall 3A.

To cancel the lock state between the long side wall 2B and the short side wall 3A by the lock member L100, the operation portion L100*a* of the lock member L100 which is positioned in upward state (lock state) is pivotally moved downward using, as a pivotal point, the pivotal-supporting holes 200*f*1 formed in the support pieces 200*f* and the pivotal shaft 100*a*3 of the operation portion L100*a* fitted into the pivotal-supporting holes 200*f*1.

Figure 29:
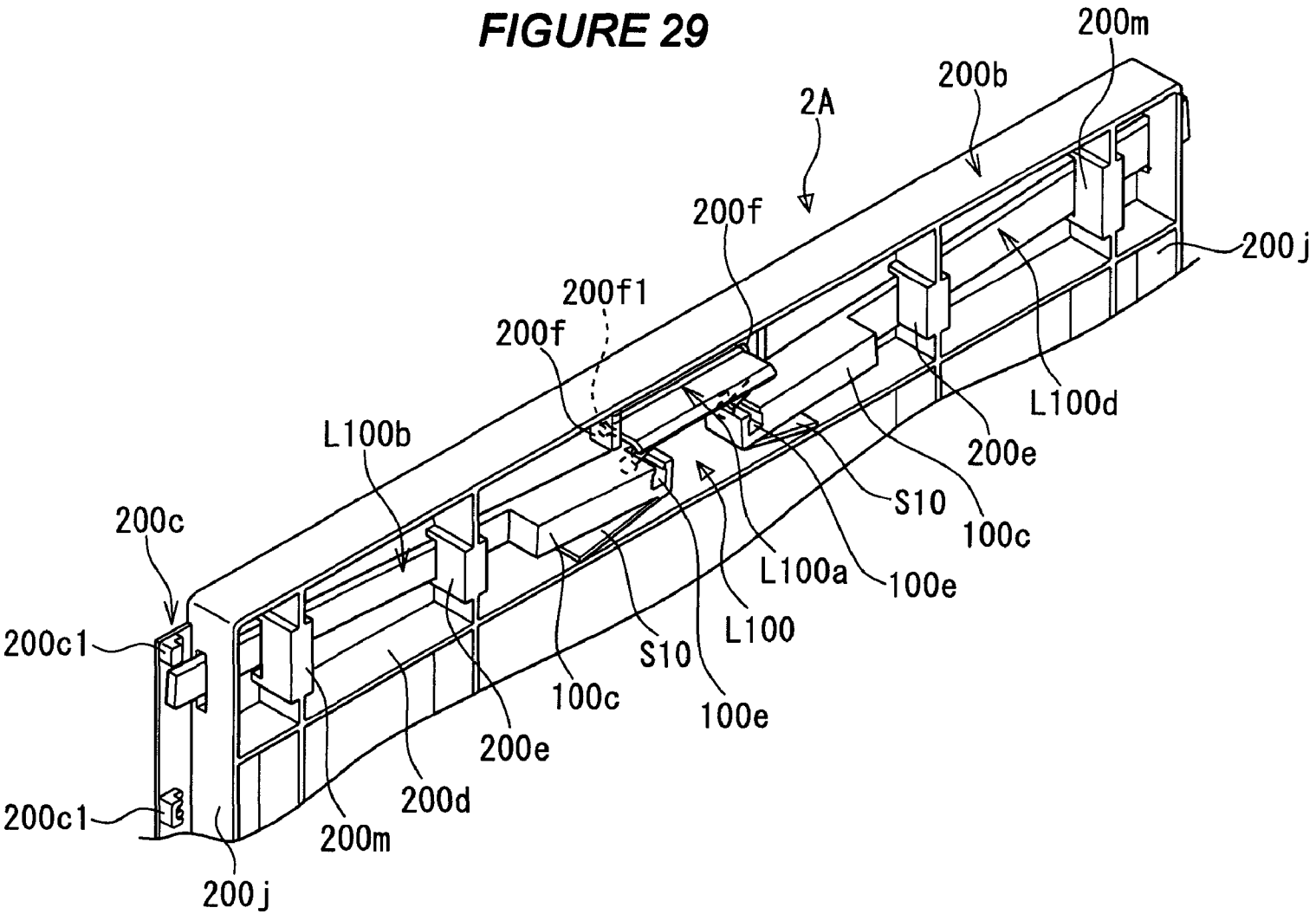
FIG. 29 is a partly perspective view of a long side wall of the folding container shown in FIG. 25.

As described above, when the operation portion L100*a* of the lock member L100 is moved downward, the operation bars 100*b* of the operation portion L100*a* move toward the plate-like portion 2*a* of the long side wall 2B. Then, as shown in FIG. 29, the tip portion of each of the lock bars L100*b* moves upward using, as a lever support point, the horizontal lower end forming the lever slit 200*e*1 drilled in the central coupling vertical rib 200*e* and serving as a lever support point.

As described above, moving the tip portion of each of the lock bars L100*b* upward allows cancellation of the lock state between the locking piece (not shown in the drawings) formed on the short side wall-side engaging member 3*c* of the short side wall 3A and the lock bar L100*b* attached to the long side wall 2B. Thus, the long side wall 2B falls down toward the bottom portion 1. This type of folding container is well known (see, for example, the Unexamined Japanese Patent Application Publication (Tokkai) No. 2003-40263).

Figure 30:
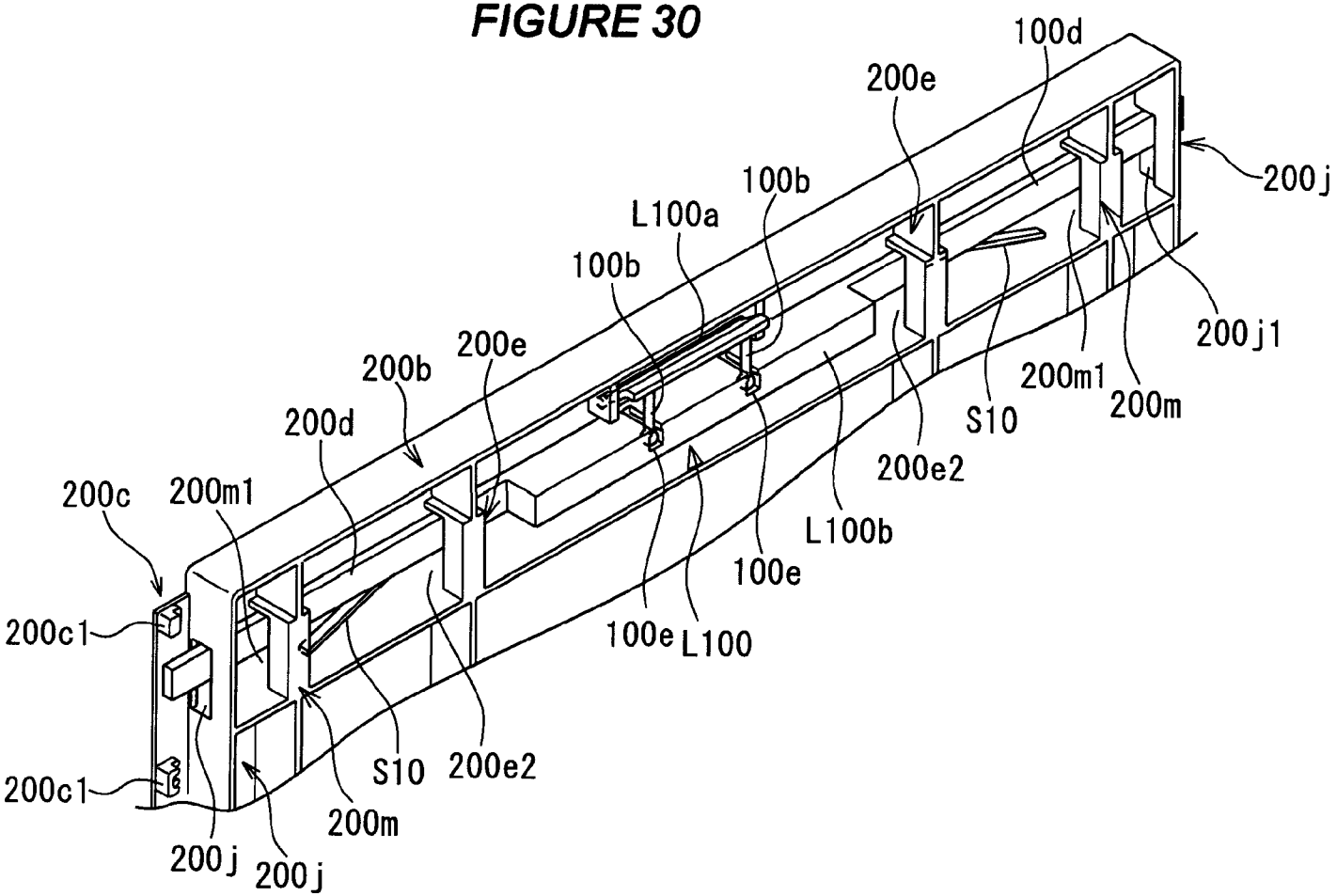
FIG. 30 is a partial perspective view of a long side wall to which a variation of the lock member shown in FIG. 25 is assembled.

The embodiment shown in FIG. 30 corresponds to the above-described embodiment in which the paired lock bars L100*b* are integrated into the appropriate components. In this configuration, pivotally moving the operation portion L100*a* downward allows the lock bars L100*b* to lower while remaining parallel to the upper horizontal rib 200*d*. Thus, a slit 200*e*2 is drilled in each of the central coupling vertical ribs 200*e* so that the corresponding lock bar L100*b* can move up and down through the slit 200*e*2; the slit 200*e*2 is similar to the slit 200*m*1 formed in the intermediate end-side coupling vertical rib 200*m* and the slit 200*j*1 formed in the terminal vertical rib 200*j*.

In the configuration of the above-described embodiment, the long side wall 2A and the short side wall 3A are unlocked by pivotally moving the operation portions L1*a*, L100*a* downward. The long side wall 2A and the short side wall 3A are locked by pivotally moving the operation portions L1*a*, L100*a* upward. However, in an alternative configuration, the long side wall 2A and the short side wall 3A may be unlocked by pivotally moving the operation portions L1*a*, L100*a* upward, and the long side wall 2A and the short side wall 3A may be locked by pivotally moving the operation portions L1*a*, L100*a* downward.

I claim:

1. A folding container having first opposite side walls which, when the folding container is in an assembled box form, are brought down firstly toward a bottom portion and second opposite side walls which are brought down secondly toward the bottom portion after the first opposite side walls have been brought down, the folding container being characterized in that a lock member comprising an operation portion and a lock bar is disposed on each of the first opposite side walls to be brought down firstly toward the bottom portion, and said operation portion being pivotally mounted in each of the first opposite side walls to be brought down firstly toward the bottom portion around a fixed pivot axis when said first opposite side walls are in an upright fixed position, using pivot pins pivotally supported within bearing holes, and to allow cancellation of a locked state between the lock member and each of the second opposite side walls to be brought down secondly toward the bottom portion, the operation portion is, when the lock member is in the locked state, pivotally moved around said fixed pivot axis upward or downward.

2. The folding container of claim 1, wherein said operation portion has pivot pins that are received within bearing holes formed in said first opposite side wall.

3. The folding container of claim 1, wherein pivotal movement of said operation portion around said fixed pivot axis is transmitted via a cam mechanism to horizontal movement of two opposing lock bars disposed on opposite sides of said operation portion.

4. The folding container of claim 2, wherein pivotal movement of said operation portion around said fixed pivot axis is transmitted via a cam mechanism to horizontal movement of two opposing lock bars disposed on opposite sides of said operation portion.

5. The folding container of claim 1, wherein pivotal movement of said operation portion around said fixed pivot axis is biased via a spring in a first direction to cause said lock bar to move to said locked state and wherein said operation portion is configured to be manually pivoted in a direction opposite to said first direction against a force of said spring to cause said lock bar to move to an unlocked state.

6. The folding container of claim 2, wherein pivotal movement of said operation portion around said fixed pivot axis is biased via a spring in a first direction to cause said lock bar to move to said locked state and wherein said operation portion is configured to be manually pivoted in a direction opposite to said first direction against a force of said spring to cause said lock bar to move to an unlocked state.

7. The folding container of claim 3, wherein pivotal movement of said operation portion around said fixed pivot axis is biased via a spring in a first direction to cause said lock bar to move to said locked state and wherein said operation portion is configured to be manually pivoted in a direction opposite to said first direction against a force of said spring to cause said lock bar to move to an unlocked state.

8. The folding container of claim 4, wherein pivotal movement of said operation portion around said fixed pivot axis is biased via a spring in a first direction to cause said lock bar to move to said locked state and wherein said operation portion is configured to be manually pivoted in a direction opposite to said first direction against a force of said spring to cause said lock bar to move to an unlocked state.

* * * * *